US007401935B2

(12) United States Patent
VanderSchuit

(10) Patent No.: US 7,401,935 B2
(45) **Date of Patent: *Jul. 22, 2008**

(54) BEVERAGE ACCESSORY DEVICES

(76) Inventor: Carl R. VanderSchuit, 751 Turquoise St., San Diego, CA (US) 92109

( * ) Notice: Subject to any disclaimer, the term of this patent is extended or adjusted under 35 U.S.C. 154(b) by 161 days.

This patent is subject to a terminal disclaimer.

(21) Appl. No.: 11/454,222

(22) Filed: Jun. 16, 2006

(65) Prior Publication Data

US 2006/0227537 A1 Oct. 12, 2006

Related U.S. Application Data

(63) Continuation-in-part of application No. 10/998,347, filed on Nov. 24, 2004, now Pat. No. 7,063,432, which is a continuation-in-part of application No. 10/189,822, filed on Jul. 3, 2002, now Pat. No. 6,824,289, which is a continuation-in-part of application No. 09/627,961, filed on Jul. 28, 2000, now Pat. No. 6,416,198, said application No. 11/454,222 is a continuation-in-part of application No. 29/261,079, filed on Jun. 7, 2006, now Pat. No. Des. 558,387, and a continuation-in-part of application No. 29/251,536, filed on Jan. 9, 2006, now Pat. No. Des. 550,396, and a continuation-in-part of application No. 29/243,622, filed on Nov. 29, 2005, now Pat. No. Des. 550,393, and a continuation-in-part of application No. 29/243,623, filed on Nov. 29, 2005, now Pat. No. Des. 550,394, and a continuation-in-part of application No. 29/243,640, filed on Nov. 29, 2005, now Pat. No. Des. 550,395, and a continuation-in-part of application No. 29/243,639, filed on Nov. 29, 2005, now Pat. No. Des. 547,899.

(60) Provisional application No. 60/154,424, filed on Sep. 17, 1999.

(51) Int. Cl.
*F21V 33/00* (2006.01)

(52) U.S. Cl. ..... 362/101; 362/154; 362/234; 362/253; 362/276; 362/318; 362/394; 362/802; 441/16; 441/43; 441/17; 441/17.5

(58) Field of Classification Search ..... 362/96, 362/101, 154, 158, 184, 205, 234, 253, 276, 362/294, 318, 394, 802; 441/16; 43/17, 43/17.5

See application file for complete search history.

(56) References Cited

U.S. PATENT DOCUMENTS 1,107,645 A 8/1914 Benedict (Continued)

FOREIGN PATENT DOCUMENTS

CH 662 931 11/1987

(Continued)

OTHER PUBLICATIONS

People's Republic of China State Intellectual Property Office Decision on Invalidation Request (No. 8863); Patent No. 1810022.8, dated Dec. 6, 2006, 1 page.

(Continued)

*Primary Examiner*—Sharon Payne
*Assistant Examiner*—Meghan K. Dunwiddie
(74) *Attorney, Agent, or Firm*—Harness, Dickey & Pierce, P.L.C.

(57) ABSTRACT

Various embodiments relate to beverage accessory devices for use within beverage receptacles. In one exemplary embodiment, a beverage accessory device generally includes a housing having sidewalls defining a cavity therein. A substantially fluid-tight container is within the cavity of the housing. The container includes sidewalls defining a chamber. At least one of the container's sidewalls is spaced apart from at least one of the housing's sidewalls such that a portion of the housing's cavity remains separating the at least one container sidewall from the at least one housing sidewall. At least one electric light source is substantially entirely within the container's chamber. The chamber can also be configured for receiving at least one power source. The at least one electric light source is operable for illuminating at least a portion of a liquid within the beverage receptacle when the beverage accessory device is within the beverage receptacle.

28 Claims, 13 Drawing Sheets

U.S. PATENT DOCUMENTS

| | | | |
|---|---|---|---|
| 1,923,522 | A | 8/1933 | Whitehouse |
| 2,152,467 | A | 3/1939 | Crosby |
| 2,765,481 | A | 10/1956 | Manhart et al. |
| 3,099,565 | A | 7/1963 | Neuhauser |
| 3,559,224 | A | 2/1971 | Shimizu |
| 3,580,575 | A | 5/1971 | Speeth |
| 3,735,113 | A | 5/1973 | Stott |
| 3,793,755 | A | 2/1974 | Gersch et al. |
| D231,252 | S | 4/1974 | Feldman |
| 3,818,208 | A | 6/1974 | Kahl |
| 4,034,231 | A | 7/1977 | Conn et al. |
| 4,109,405 | A | 8/1978 | Ito |
| 4,124,881 | A | 11/1978 | Haber |
| 4,181,304 | A | 1/1980 | Haber |
| 4,183,316 | A | 1/1980 | Bennett |
| 4,237,525 | A | 12/1980 | Deter |
| 4,309,743 | A | 1/1982 | Martin |
| 4,325,230 | A | 4/1982 | Driscoll |
| 4,331,848 | A | 5/1982 | Schneider, Jr. |
| 4,341,087 | A | 7/1982 | Steenburgh |
| 4,390,928 | A | 6/1983 | Runge |
| 4,409,644 | A | 10/1983 | Axton et al. |
| D272,128 | S | 1/1984 | Parmentier |
| D272,232 | S | 1/1984 | Parmentier |
| 4,464,131 | A | 8/1984 | Plante et al. |
| 4,545,479 | A | 10/1985 | Figari |
| 4,553,194 | A | 11/1985 | Bailey |
| 4,554,189 | A | 11/1985 | Marshall |
| 4,556,932 | A | 12/1985 | Lehrer |
| 4,600,974 | A | 7/1986 | Lew et al. |
| 4,605,882 | A | 8/1986 | DeLuca |
| 4,638,409 | A | 1/1987 | Berman |
| 4,641,840 | A | 2/1987 | Larson |
| 4,719,544 | A | 1/1988 | Smith |
| 4,733,785 | A | 3/1988 | Turner, Jr. et al. |
| 4,761,314 | A | 8/1988 | Marshall |
| 4,796,167 | A | 1/1989 | Brown et al. |
| 4,827,655 | A | 5/1989 | Reed |
| 5,018,053 | A | 5/1991 | Belknap |
| 5,027,258 | A | 6/1991 | Schoniger et al. |
| 5,054,778 | A | 10/1991 | Maleyko |
| 5,070,435 | A | 12/1991 | Weller |
| 5,070,437 | A | 12/1991 | Roberts, Sr. |
| 5,119,279 | A | 6/1992 | Makowsky |
| 5,143,439 | A | 9/1992 | Lewis |
| 5,165,781 | A | 11/1992 | Orak |
| 5,201,578 | A | 4/1993 | Westmoland |
| 5,211,699 | A | 5/1993 | Tipton |
| 5,231,781 | A | 8/1993 | Dunbar |
| 5,253,149 | A | 10/1993 | Ostema |
| 5,276,599 | A | 1/1994 | Neeley |
| 5,295,882 | A | 3/1994 | McDermott |
| 5,323,300 | A | 6/1994 | McCrary |
| 5,438,488 | A | 8/1995 | Dion |
| 5,463,537 | A | 10/1995 | Trattner et al. |
| D365,911 | S | 1/1996 | Cassetti et al. |
| 5,497,307 | A | 3/1996 | Bae |
| 5,516,317 | A | 5/1996 | Moody |
| 5,567,037 | A | 10/1996 | Ferber |
| 5,575,533 | A | 11/1996 | Glance |
| 5,575,553 | A | 11/1996 | Tipton |
| 5,603,219 | A | 2/1997 | Kolb |
| 5,609,411 | A | 3/1997 | Wang |
| 5,622,422 | A | 4/1997 | Rodgers |
| 5,624,177 | A | 4/1997 | Rosaia |
| 5,632,548 | A | 5/1997 | Mayfarth |
| 5,636,770 | A | 6/1997 | Hachinohe et al. |
| 5,649,758 | A | 7/1997 | Dion |
| 5,653,524 | A | 8/1997 | Gray |
| 5,697,182 | A | 12/1997 | Rodgers |
| 5,743,620 | A | 4/1998 | Rojas |
| 5,763,845 | A | 6/1998 | Hsieh |
| 5,775,800 | A | 7/1998 | Hsieh |
| 5,784,265 | A | 7/1998 | Chen |
| 5,785,407 | A | 7/1998 | Ratcliffe |
| 5,860,724 | A | 1/1999 | Cheng |
| 5,876,109 | A | 3/1999 | Scalco |
| 5,879,068 | A | 3/1999 | Menashrov |
| 5,903,212 | A | 5/1999 | Rodgers |
| 5,934,519 | A | 8/1999 | Kim et al. |
| 5,934,784 | A | 8/1999 | Dion |
| 5,971,827 | A | 10/1999 | Lee et al. |
| D425,706 | S | 5/2000 | Calderone |
| 6,106,130 | A | 8/2000 | Harding |
| 6,106,132 | A | 8/2000 | Chen |
| 6,116,753 | A | 9/2000 | Tsang |
| 6,135,604 | A | 10/2000 | Lin |
| 6,155,700 | A | 12/2000 | Hsu |
| 6,254,247 | B1 | 7/2001 | Carson |
| 6,277,079 | B1 | 8/2001 | Avicola et al. |
| 6,286,974 | B1 | 9/2001 | Rochel et al. |
| 6,296,376 | B1 | 10/2001 | Kondo et al. |
| 6,344,252 | B1 | 2/2002 | Werner |
| 6,352,352 | B1 | 3/2002 | Schletterer et al. |
| 6,354,460 | B1 | 3/2002 | Cornell et al. |
| 6,354,711 | B1 | 3/2002 | McCoy |
| 6,375,092 | B1 | 4/2002 | Banach |
| 6,416,198 | B1 | 7/2002 | VanderSchuit |
| 6,481,148 | B1 | 11/2002 | Lindgren |
| 6,584,713 | B2 | 7/2003 | Huang |
| 6,666,569 | B2 | 12/2003 | Obata |
| 6,824,289 | B2 | 11/2004 | VanderSchuit |
| 6,874,909 | B2 | 4/2005 | VanderSchuit |
| 6,955,450 | B2 | 10/2005 | Johnson |
| 6,966,666 | B2 * | 11/2005 | Liu ..... 362/101 |
| 7,063,432 | B2 * | 6/2006 | VanderSchuit ..... 362/101 |
| 2003/0090892 | A1 | 5/2003 | Su |
| 2003/0161144 | A1 | 8/2003 | McKinney |
| 2004/0130886 | A1 * | 7/2004 | Lewis et al. ..... 362/101 |
| 2004/0233674 | A1 | 11/2004 | VanderSchuit |
| 2004/0264173 | A1 | 12/2004 | VanderSchuit |
| 2004/0264176 | A1 | 12/2004 | VanderSchuit |
| 2004/0264187 | A1 | 12/2004 | VanderSchuit |
| 2005/0073833 | A1 | 4/2005 | VanderSchuit |
| 2005/0083676 | A1 | 4/2005 | VanderSchuit |
| 2005/0180146 | A1 | 8/2005 | VanderSchuit |
| 2005/0187597 | A1 | 8/2005 | VanderSchuit |
| 2005/0259435 | A1 | 11/2005 | VanderSchuit |

FOREIGN PATENT DOCUMENTS

| | | |
|---|---|---|
| CN | 033562709 | 8/2003 |
| CN | 033562717 | 8/2003 |
| DE | 299 18 185 | 2/2000 |
| EP | 0 231 471 | 2/1986 |
| EP | 1313986 | 5/2003 |
| GB | 2381575 | 5/2003 |
| GB | 2392973 | 3/2004 |
| JP | 06-267327 | 9/1994 |
| JP | 07-289405 | 11/1995 |
| JP | 2002-245802 | 8/2002 |
| JP | 2003-137014 | 5/2003 |
| JP | 2003-259951 | 9/2003 |
| JP | 2004-105231 | 4/2004 |
| WO | WO 93-18358 | 2/1993 |
| WO | WO 02/10642 | 2/2002 |
| WO | WO 04/005796 | 11/2003 |

OTHER PUBLICATIONS

Memorandum and Order dated Aug. 25, 2006; *Litecubes, L.L.C., et al* v. *Northern Light Products, Inc.*, Case No. 4:04CV00485 ERW, 35 pages.

U.S. Appl. No. 29/243,622, VanderSchuit, filed Nov. 29, 2005.

Design U.S. Appl. No. 29/243,639, VanderSchuit, filed Nov. 29, 2005.
Design U.S. Appl. No. 29/243,640, VanderSchuit, filed Nov. 29, 2005.
Design U.S. Appl. No. 29/243,623, VanderSchuit, filed Nov. 29, 2005.
Design U.S. Appl. No. 29/251,536, VanderSchuit, filed Jan. 9, 2006.
Design U.S. Appl. No. 29/261,079, VanderSchuit, filed Jun. 7, 2006.
The Written Opinion for International Application PCT/US01/16640, dated Apr. 25, 2002, 7 pages.
International Preliminary Examination Report for International Application PCT/US01/16640, dated Jan. 27, 2003, 7 pages.
International Search Report dated Nov. 3, 2003 from PCT Application Serial No. PCT/US03/20521 filed Jun. 27, 2003, claiming priority to U.S. Appl. No. 10/189,822, 5 pages.
European Examination Report, Application No. 01 939 305.7-2313, 3 pages.
United Kingdom Combined Search and Examination Report dated Jan. 6, 2004; Application No. GB 0326549.3; 4 pages.
Supplementary European Search Report dated Mar. 8, 2004; App. No. EP 01 93 9305; 3 pages.
Second European Examination Report, Application No. 01 939 305.7, dated Oct. 1, 2004, 3 pages.
Special Verdict Form with jury decision rendered on Oct. 7, 2005 from litigation in the U.S. District Court for the Eastern District of Missouri captioned *Litecubes, LLC and Carl R. Vanderschuit* v. *Northern Ligth Products, Inc.*, Case No. 4:04CV00485 ERW, 5 pages.
Memorandum and Order dated Sep. 2, 2005 from litigation in the U.S. District Court for the Eastern District of Missouri captioned *Litecubes, LLC and Carl R. Vanderschuit* v. *Northern Ligth Products, Inc.*, Case No. 4:04CV00485 ERW, 8 pages.
Memorandum and Order dated Aug. 2, 2005 from litigation in the U.S. District Court for the Eastern District of Missouri captioned *Litecubes, LLC and Carl R. Vanderschuit* v. *Northern Ligth Products, Inc.*, Case No. 4:04CV00485 ERW, 12 pages.
International Search Report; App. No. PCT/US05/42741; dated Apr. 4, 2006; 3 pages.
Written Opinion; App. No. PCT/US05/42741; dated Apr. 4, 2006; 5 pages.

* cited by examiner

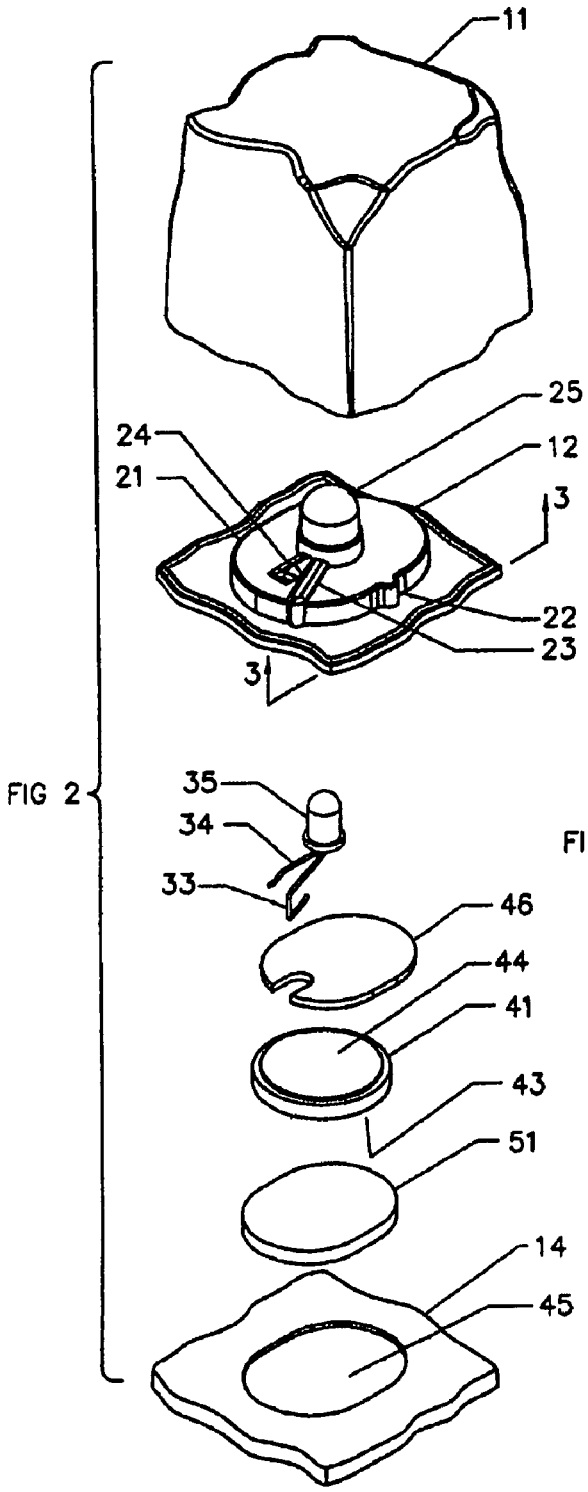
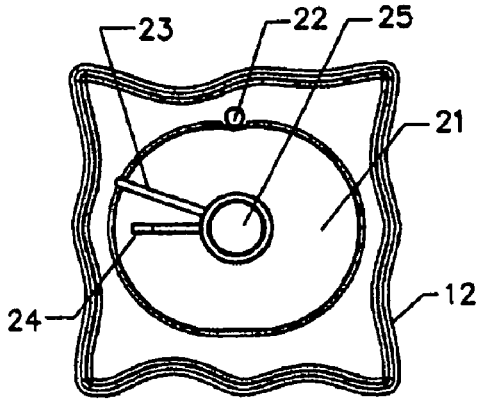
FIG 3
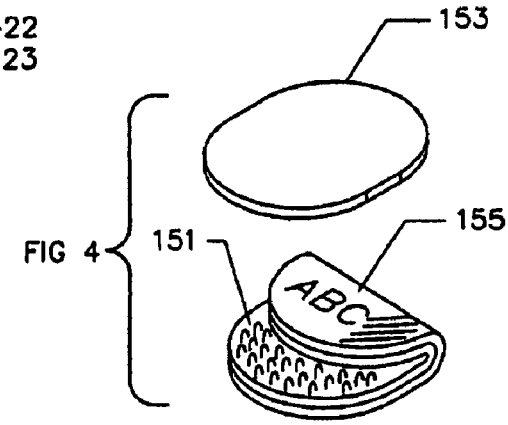
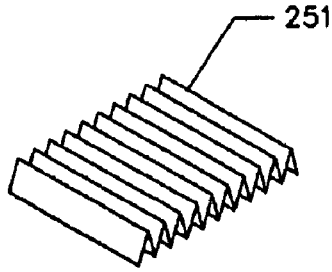
FIG 5

BEVERAGE ACCESSORY DEVICES

CROSS-REFERENCE TO RELATED APPLICATIONS

This application is a continuation-in-part of allowed U.S. patent application Ser. No. 10/998,347 filed Nov. 24, 2004, which is a continuation-in-part of U.S. patent application Ser. No. 10/189,822 filed Jul. 3, 2002 (now U.S. Pat. No. 6,824,289 issued Nov. 30, 2004), which is a continuation-in-part of U.S. patent application Ser. No. 09/627,961 filed Jul. 28, 2000 (now U.S. Pat. No. 6,416,198 issued Jul. 9, 2002), which claimed priority to U.S. Provisional Patent Application 60/154,424, filed Sep. 17, 1999. This application is a continuation-in-part of U.S. Design Patent Application No. 29/243,639 filed Nov. 29, 2005. This application is a continuation-in-part of U.S. Design Patent Application No. 29/243,640 filed Nov. 29, 2005. This application is a continuation-in-part of U.S. Design Patent Application No. 29/243,623 filed Nov. 29, 2005. This application is a continuation-in-part of U.S. Design Patent Application No. 29/243,622 filed Nov. 29, 2005. This application is a continuation-in-part of U.S. Design Patent Application No. 29/251,536 filed Jan. 9, 2006. This application is a continuation-in-part of U.S. Design Patent Application No. 29/261,079 filed Jun. 7, 2006. The disclosures of the above applications are incorporated herein by reference.

FIELD

The present invention relates generally to novelty-related accessory items, and more particularly (but not exclusively) to illuminating beverage accessory devices for use in containers filled with liquids.

BACKGROUND

The statements in this section merely provide background information related to the present disclosure and may not constitute prior art.

Currently, there are several novelty-related devices resembling ice cubes. But they are either complex in structure or in use or both. For example, U.S. Pat. No. 5,860,724 issued to Cheng describes a luminescent light emitter shaped like an ice cube having several chambers each filled with chemicals that when mixed together emit light. But the Cheng device has a complex construction, requiring chemicals, and is relatively burdensome to use.

U.S. Pat. No. 5,903,212 issued to Rodgers is even more complex. The Rodgers device is motion-sensitive such that the device is powered by any motion through a motion-responsive ball-switch within. Although relatively easy to use, the Rodgers device has an extremely complex structure.

SUMMARY

Various embodiments relate to beverage accessory devices for use within beverage receptacles. In one exemplary embodiment, a beverage accessory device generally includes a housing having sidewalls defining a cavity therein. A substantially fluid-tight container is within the cavity of the housing. The container includes sidewalls defining a chamber. At least one of the container's sidewalls is spaced apart from at least one of the housing's sidewalls such that a portion of the housing's cavity remains separating the at least one container sidewall from the at least one housing sidewall. At least one electric light source is substantially entirely within the container's chamber. The chamber can also be configured for receiving at least one power source. The at least one electric light source is operable for illuminating at least a portion of a liquid within the beverage receptacle when the beverage accessory device is within the beverage receptacle.

In another exemplary embodiment, a beverage accessory device generally includes a housing and at least one electric light source within the housing. Gel is also within the housing. The at least one electric light source is operable for illuminating at least a portion of a liquid within the beverage receptacle when the beverage accessory device is within the beverage receptacle.

In another exemplary embodiment, a beverage accessory device generally includes a housing and at least one electric light source within the housing. Light-altering particles are also within the housing. The light-altering particles can receive and alter light from the at least one electric light source by at least one or more of refracting, reflecting, diffracting, dispersing, and diffusing. The at least one electric light source is operable for producing light, which can be altered by the light-altering particles such that the altered light illuminates at least a portion of a liquid within the beverage receptacle when the beverage accessory device is within the beverage receptacle.

In another exemplary embodiment, a beverage accessory device generally includes a housing and at least one electric light source within the housing. A beaded material is also within the housing. The beaded material includes a plurality of surfaces positioned relative to the at least one electric light source such that they can receive and alter light from the at least one electric light source. The at least one electric light source is operable for producing light at least a portion of which can be altered by the beaded material and illuminate at least a portion of a liquid within the beverage receptacle when the beverage accessory device is within the beverage receptacle.

Further aspects and features of the present disclosure will become apparent from the detailed description provided hereinafter. In addition, any one or more aspects of the present disclosure may be implemented individually or in any combination with any one or more of the other aspects of the present disclosure. It preferably should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

FIG. 2 is an exploded view of the beverage accessory of FIG. 1;

FIG. 3 is a planar view of a portion of the beverage accessory as taken along line 3-3 of FIG. 2;

FIG. 4 is an exploded detail view of a support member for a power source according to one embodiment of the invention;

FIG. 5 is a detailed view of another embodiment of a support member for a power source;

DETAILED DESCRIPTION

Figure 1:
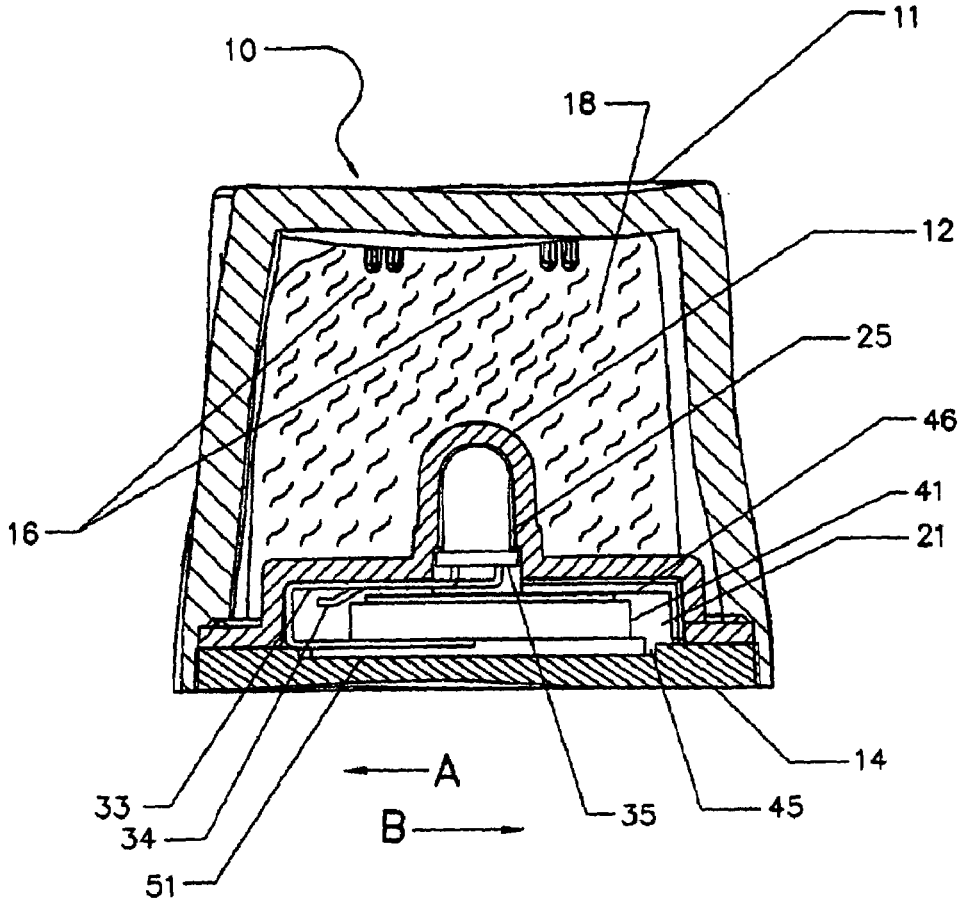
FIG. 1 is a cross-sectional elevation view of the beverage accessory according to one embodiment of the invention.

The following description is merely exemplary in nature and is in no way intended to limit the present disclosure, application, or uses.

Various embodiments provide beverage accessory devices, which generally include a housing having sidewalls defining a cavity therein. A substantially fluid-tight container is within the cavity of the housing. The container includes sidewalls defining a chamber. At least one of the container's sidewalls is spaced apart from at least one of the housing's sidewalls such that a portion of the housing's cavity remains separating the at least one container sidewall from the at least one housing sidewall. At least one electric light source is substantially entirely within the container's chamber. The chamber can also be configured for receiving at least one power source. The at least one electric light source is operable for illuminating at least a portion of a liquid within the beverage receptacle when the beverage accessory device is within the beverage receptacle. In some of these embodiments, the inner container may be removable from the housing to thereby allow access to the components within the container, such as battery replacement, etc. A filler (e.g., fluid, liquid, gas, gel, light-altering particles, beaded material, etc.) can also be disposed within at least that portion of the cavity separating the at least one container sidewall from the at least one housing sidewall. In those embodiments that include fillers, the container can substantially isolate the at least one electric light source and the filler by inhibiting contact therebetween. And, depending on the particular embodiment and filler material used, the filler may also suspend the container in a suspended position within the housing's cavity such that a spaced distance separates each container sidewall from each housing sidewall. Some embodiments may also include electrical terminals that are external to the housing for switchably connecting the at least one electric light source to at least one power source when the beverage accessory device is placed in a liquid and the liquid electrically connects the terminals to one another. These electrical terminals may be defined by at least one conductor extending from within the container's chamber through the housing's cavity and terminating external to the housing. In some embodiments, the container can also be configured to encapsulate the at least one electric light source and at least one conductor electrically connected to the at least one electric light source such that the container supports and restrains movement of the at least one electric light source relative to the at least one conductor. The housing and the container can be substantially transparent such the housing and the container are not readily visible when the beverage accessory device is within a liquid and/or when the at least one electric light source is emitting light. In some embodiments, the housing can integrally define a portion of the container.

Other exemplary embodiments provide beverage accessory devices, which generally include a housing and at least one electric light source within the housing. Gel is also within the housing. The at least one electric light source is operable for illuminating at least a portion of a liquid within the beverage receptacle when the beverage accessory device is within the beverage receptacle. A wide range of materials can be used for the gel including one or more gels configured (e.g., having a chemical composition or make-up, etc.) to allow contact between the gel and the beverage accessory's electronic components without affecting the electrical properties or performance of thereof, such as the light source(s) (e.g. one or more LEDs, etc.), power source(s) (e.g., one or more batteries, etc.), and/or conductive lead(s), gels formed from polyacrylamide and petroleum oil, gels comprising beaded materials (e.g., plastic and/or acrylic pellets, etc.), gels having a specific heat capacity within a range of about 2300 joules per kilogram per degree Celsius to about 2500 joules per kilogram per degree Celsius, gels formed from polyethylene and/or polypropylene, gels in which one or more light-altering particles are suspended (e.g., glitter, reflective particles, refractive particles, translucent particles, glass-like prisms, colored particles, faceted particles, clear particles, etc.), among other suitable gels.

Further exemplary embodiments provide beverage accessory devices, which generally include a housing and at least one electric light source within the housing. Light-altering particles are also within the housing. The light-altering particles can receive and alter light from the at least one electric light source by at least one or more of refracting, reflecting, diffracting, dispersing, and diffusing. The at least one electric light source is operable for producing light, which can be altered by the light-altering particles such that the altered light illuminates at least a portion of a liquid within the beverage receptacle when the beverage accessory device is within the beverage receptacle. The light-altering particles may comprise a wide range of materials and configurations, such as glitter, reflective particles, refractive particles, translucent particles, glass-like prisms, colored particles, faceted particles, clear particles, beaded materials, gels, etc. The light-altering particles can be suspended within a filler (e.g., gel, etc.). In some embodiments, the housing is substantially transparent such that the housing is not readily visible when the beverage accessory device is within a liquid and/or when the at least one electric light source is emitting light being altered by the light-altering particles.

Still further exemplary embodiments provide beverage accessory devices, which generally include a housing and at least one electric light source within the housing. A beaded material is also within the housing. The beaded material includes a plurality of surfaces positioned relative to the at least one electric light source such that they can receive and alter light from the at least one electric light source. The at least one electric light source is operable for producing light at least a portion of which can be altered by the beaded material and illuminate at least a portion of a liquid within the beverage receptacle when the beverage accessory device is within the beverage receptacle. In some embodiments, the beaded material is configured for altering light emitted by the at least one electrical light source by at least one or more of refracting, reflecting, diffracting, and dispersing light. A wide range of materials can be used for the beaded material including one or more of plastic and/or acrylic pellets.

In various exemplary embodiments, a beverage accessory generally includes a substantially water-tight housing and at least one light source within the housing. The beverage accessory device also includes filler within the housing. The filler is tailored or configured (e.g., has a particular chemical composition or make-up, etc.) such that the filler does not affect electrical properties or performance of the electronic components within the housing of the beverage accessory device, such as the light source (e.g. one or more LEDs, etc.), power sources (e.g., one or more batteries, etc.), and/or conductive leads. Tailoring or selecting a filler that will not affect the integrity and/or degrade the electronic components of the beverage accessory device can allow for elimination of a second container (e.g., cartridge, pod, second housing, etc.) within the housing for keeping the electronic components separate and isolated from the filler. In one particular embodiment, the filler includes gel formed from a coplymer with petroleum oil. In another embodiment, the filler includes gel formed from a polyacrylamide with petroleum oil. In another embodiment, the filler includes a plastic material in beaded form or pellet form. Alternative fillers can be used in other embodiments.

Various embodiments can include luminous fillers (e.g., luminous gel, etc.) in addition to one or more electric light sources. As recognized by the inventor hereof, such embodiments can provide better and bright illumination in relatively cold environments as compared to those devices relying solely on luminous gels. This is because luminous gels generally do not provide bright illumination in relatively cold environments as compared to the illumination produced by electric light sources, such as LEDs.

In another exemplary embodiment, a beverage accessory device includes a substantially water-tight housing and at least one light source within the housing. Electrical terminals are located external to the housing for switchably connecting the light source to a power source when the beverage accessory device is placed in a liquid such that the liquid electrically connects the terminals to one another. When the light source is connected to the power source, the light source illuminates at least a portion of a liquid in which the beverage accessory device is placed. With the electrical terminals external to the housing, liquid within the beverage container (e.g., glass, cup, etc.) can complete the circuit for delivering electrical power for operating the light source without that liquid having to enter the substantially water-tight housing of the device. This is unlike those devices with internal electrical terminals where liquid must be drawn into the housing for electrically connecting the light source to the power source. This particular beverage accessory device can also include a substantially water-tight container (e.g., a second housing, pod, etc.) within the outer housing. The light source and/or the power source can be positioned and/or supported within this inner container, which, in turn, is disposed within the outer housing. In addition, this example of the beverage accessory device may also include one or more fillers within the housing, such as any one or more of the fillers disclosed herein.

In another exemplary embodiment, a beverage accessory device includes a housing, at least one light source within the housing, and a push-button switching device for switchably connecting the light source to a power source. When the light source is connected to the power source, the light source illuminates at least a portion of a liquid in which the beverage accessory device is placed. This particular beverage accessory device can also include a substantially water-tight container (e.g., a second housing, pod, etc.) within the outer housing. The light source and/or the power source can be positioned and/or supported within this inner container, which, in turn, is disposed within the outer housing. This particular beverage accessory device can also include a substantially water-tight container (e.g., a second housing, pod, etc.) within the outer housing. The light source and/or the power source can be positioned and/or supported within this inner container, which, in turn, is disposed within the outer housing. In addition, this example of the beverage accessory device may also include one or more fillers within the housing, such as any one or more of the fillers disclosed herein.

In another exemplary embodiment, a beverage accessory device includes a housing, at least one light source within the housing, and a chamber adapted to receive at least one power source for powering the light source. The chamber is sized to permit the power source to reciprocally translate therein for switchably connecting the light source to the power source. When the light source is connected to the power source, the light source illuminates at least a portion of a liquid in which the beverage accessory device is placed. This particular beverage accessory device can also include a substantially water-tight container (e.g., a second housing, pod, etc.) within the outer housing. The light source and/or the power source can be positioned and/or supported within this inner container, which, in turn, is disposed within the outer housing. In addition, this example of the beverage accessory device may also include one or more fillers within the housing, such as any one or more of the fillers disclosed herein.

Any one or more aspects of the present disclosure may be implemented individually or in any combination with any one or more of the other aspects of the present disclosure.

Referring now to the drawings in detail and in particular to FIG. 1, reference character 10 generally designates a beverage accessory device constructed in accordance with one embodiment of the present invention.

As shown, the beverage accessory device 10 includes a housing 11 which rests on a lid 14. Within the housing 11 seated on the lid 14 is a cartridge 12. A cavity is, though need not be, formed above the cartridge 12. A cavity is preferred but the space above the cartridge 12 also may be part of the inner housing itself, a single-piece or of a solid construction fitted onto or be a part of the cartridge 12. This solid inner housing may be transparent or translucent and/or comprise any one or more colors or tints or shades.

The cartridge 12 can be fixedly sealed to the lid 14 and each, the cartridge 12 and the lid 14, can be fixedly sealed to the housing 11 thereby creating a water-tight integrity for the beverage accessory device 10. It must be understood, however, that any one or more of these parts (that is, the housing 11, the cartridge 12, and the lid 14) may be removably attached to any one or all of the other parts, or fixedly attached to any one or all of the others, or in any combination thereof. For maintaining water-tight integrity, a fixed seal is preferred.

Reference is now made to FIGS. 1 through 3. Within the cartridge 11 is a light source chamber 25, a power source chamber 21, a detent 22 or similar structure suited for the intended purpose of restricting the (unwanted) movement of the power source 41 (having a negative terminal or cathode 44 and a positive terminal or anode 43) within the power source chamber 21, and wire lead channels 23, 24 adapted to receive the respective wire leads 33, 34 from the light source 35. The light source 35 seats into the light source chamber 25. Its wire leads 33, 34 seat into the respective wire lead channels 23, 24 of the underside of the cartridge 12. The power source 41 is seated into the power source chamber 21 directly below the light source 35. The power source chamber 21 is sized such that the power source 41 may slide from one side to another side as depicted by direction arrows A and B in FIG. 1 (for reference purposes only, and not by way of limitation, FIG. 1 depicts a right to left translation of the power source 41 and in this vein, the power source chamber 21 is slightly longer than the length of the power source 41). Side to side length of the power source chamber 21 is slightly less than the length of the power source 41 to provide the clearance necessary to permit movement in directions A and B when desired. Undesired movement within the power source chamber 21 of the power source 41 is restricted by placement of a detent 22 within the power source chamber 21, or similar structure suited for the intended purpose such as, but not limited to a nub, a bias member, a pin, and the like. Those skilled in the art, however, will recognize that any restricting-type mechanism suited for the intended purposes may be employed and are not limited to these forms of restricting-type mechanisms described above.

One wire lead (for example purposes only, and not by way of limitation, it is wire lead 33) extends from the light source 35 around the inner perimeter of the power source chamber 21 to the bottom of the power source 41 as follows: from upper chamber wall to the left side wall then down to the bottom chamber wall and then to the right. This wire lead 33 is in continuous communication with one terminal of the power source (for example purposes only, and not by way of limitation, the wire lead 33 communicates with the positive terminal on the bottom of the power source 41). Below the power source 41 and inside the lid chamber 45 is a bias member 51. The bias member 51 is seated in the lid chamber 45 and is adapted to apply force on and/or support to the power source 41 such that the power source 41 does not and cannot easily move or translate from side to side (directions of arrows A or B) unless external force is applied to overcome the force and support being applied by the bias member 51 to then cause such movement.

Wire lead 34 from light source 35 in this example is the negative lead and seats in lead channel 34 of the underside of the cartridge 21. As illustrated in FIG. 1, this wire lead 34 is positioned well away from contact with the power source 41 when power source 41 is, by way of this example only, in the full right side position (moved fully in the direction of arrow B). This wire lead 34 is slightly downward angled left of center such that, when the power source 41 is slid in the direction of arrow A, the top side (in this example, the negative terminal) of the power source 41 contacts this wire lead 34 thereby completing the circuit causing the light to power 'on'. When the power source is slid sufficiently in the direction of arrow B, contact between the wire lead 34 and the negative terminal of the power source 41 is broken and light emission from the light source 35 will terminate. To prevent undesired contact between wire lead 33 (positive in this example) and the negative terminal of the power source (top in this example) and undesired contact between wire lead 34 (negative lead in this example) and the negative terminal of the power source 41 (top in this example) an insulator has been inserted on the top (as viewed from the perception of FIG. 1) of the power source chamber 21 between the two wire leads 33, 34 and the top of the power source 41. The insulator 46, however, should extend approximately up to wire lead 33 at a point where it is desired that the wire lead 33 come in contact with the top of the power 41 when the power source 41 is caused to move in direction A (in this example, and not by way of limitation, this point is approximately where the downward angling of wire lead 33 begins).

The beverage accessory device is preferably formed from biologically safe material that has properties suitable for placing it in contact with a material that is to be ingested and falls under the Food and Drug Administration food-contact grade properties. Exemplary materials include polymers, plastics, flexible materials, rigid materials, materials capable of being mass produced with relatively low manufacturing costs, among other materials suited for the intended purpose.

The beverage accessory device also could be manufactured from, or filled with, a material capable of maintaining cold or heat if the beverage accessory device is cooled or heated as the case may be. As such, the beverage accessory device could impart such properties to a drink if desired. As stated earlier, the housing 11 may be hollow; that is, have a cavity within and above the cartridge 12. In such cases, the cavity may be filled with a filler 18 such as, but not limited to, water, jell, powder, metals, heat-retaining materials, cold-retaining materials, ultra-violet materials, materials having a fluorescent or glow-in-the-dark quality and the like, all may be either colored or clear or translucent or any combination thereof. Depending on the material used, such filler 18, if frozen or heated, could impart greater cooling or heating properties, respectively, than a solid housing 11. For cooling and heating properties, a wide range of suitable materials can be used including commercially available materials bearing cold-retaining and/or heat-retaining properties such as, but not limited to, materials generally used in re-usable ice-packs, re-usable heating pads, hot/cold gel packs, single-use hand and toe warmers, among other suitable known (and presently unknown) materials. Those skilled in the art, however, will recognize that any filler suited for the intended purposes may be employed and are not limited to these forms of fillers described above. Glow-in-the-dark fillers of varying colors are well-suited for mood enhancing. Positively buoyant fillers are well-suited to establish positive buoyancy such that the device will float within the liquid. Any convention fillers suited for the intended purpose and purposes will suffice.

Having a solid inner housing 11 or a filler 18 within creates a negative buoyancy to the beverage accessory device. Adjusting such combinations of filler 18 and/or solid inner housing 11 or retaining an unused cavity would generally create a positive buoyancy for the beverage accessory device. Since the beverage accessory device could be used as a novelty ice cube, its outer features could simulate the contours and somewhat curved corners of a real ice cube. It could resemble that of a melted or partially melted or melting ice cube complete with a convoluted exterior surface. Shape, for this purpose, would enhance the pleasure of its use. Indicia, external or internal, could be displayed by the beverage accessory device. Such indicia could impart holiday themes, professional themes, promotional themes, sports related themes, and the like. Those skilled in the art, however, will recognize that any theme suited for the intended purposes may be employed and are not limited to these types of themes described above.

In an embodiment where the lid chamber 45 is somewhat or completely transparent, the portion of the bias member 51 which is exposed to the lid chamber 45 (bottom of bias member 51 for example) could contain any indicia which, as a result of the transparency of the lid chamber 45, is exposed to outside viewers. As above, such indicia also could impart holiday themes, professional themes, promotional themes, sports related themes, and the like. This bottom of the bias member 51 could be of a glossy surface, a non-glossy surface, smooth, or textured, or any combination thereof.

In an embodiment where the inner housing 11 is a cavity, a display mechanism 16 may be connected to any one or more side walls or the top of the housing 11. The display mechanism is adapted to receive and hold, but is not limited to, a display placard, plaque, card, any two- or three-dimensional objects, and the like, or any combination thereof which may convey a message, project an image or impression, or to merely bring entertainment to the user of the beverage accessory device; to the user. Any display mechanism suited for the intended purpose will suffice, including, but not limited to, clips, slots, hooks, rollers, tabs, and the like. Those skilled in the art, however, will recognize that any display mechanism suited for the intended purposes may be employed and are not limited to these forms of display mechanisms described above.

The light source 35 can be any source which can illuminate the beverage accessory device and preferably the surrounding environment into which the beverage accessory device is placed; into a drink (floating or not), in a planter, in a fish bowl, on a dinner table, at a picnic, and the like. Any light source 35 suited for the intended purpose will suffice, such as, but not limited to light-emitting diodes (LEDs), fiber optics, halogen, incandescent, laser, fluorescent, phosphorescent, chemiluminescent, electroluminescent, neon light sources, ultraviolet lights, black lights, magnetic, and the like. It is preferred, however, that the light source 35 not impart excessive or undesired heat or temperature to the beverage accessory device and the surrounding liquid or drink. An LED is preferred, however, those skilled in the art will recognize that any light source mechanism suited for the intended purposes may be employed and are not limited to these forms of light source mechanisms described above.

The power source 41 contemplates any means of providing energy to the light source 35 to thereby cause the light source 35 to emit light. A power source 41 suited for the intended purpose will suffice including, but not limited to, renewable batteries, rechargeable batteries, disposable batteries, power cells, watch batteries, rechargeable or quick-charging capacitors, and the like. If rechargeable, such power source 41 should be rechargeable by solar, magnetic, electrical, and chemical means, and the like or any combination thereof. One embodiment directs that the power source 41 be fully contained within the beverage accessory device and not to be in contact with its external environment. Those skilled in the art will recognize, however, that any power source mechanism suited for the intended purposes may be employed and are not limited to these forms of power source mechanisms.

The bias member 51 may be comprised of any suitable material or structure suited for the intended purpose such as, but not limited to a spring, a resilient pad, a single piece of VELCRO material, a foam pad, a corrugated plate, a spring plate, and the like or any combination thereof. In the preferred embodiment a foam-like member 51 is used. A typical foam-like member may be, but is not limited to, rubber, vinyl, polyethylene polyester, styrofoam, and the like, or any combination thereof.

A single piece of VELCRO material 151 (that is, the hook side of a hook-and-loop VELCRO, or the loop side of a hook-and-loop VELCRO) may also be used (see FIG. 4). In such case, a cover 153 would be placed on the VELCRO portion of this material. The VELCRO portions give this element the spring-like quality necessary to apply pressure or force to the power source 41 to thereby, in the process, provide support for the power source 41 within the power source chamber 21 and prevent unwanted movement. Printed indicia, as explained above, would be on the reverse side 155. FIG. 5 illustrates another exemplary type of bias member, which is a corrugated plate-like member 251. What is necessary for the support is application of upward force on the power source 41 to prevent it from moving when movement is not desired. Those skilled in the art will recognize, however, that any force applying mechanisms suited for the intended purposes may be employed and are not limited to these forms of bias member mechanisms.

Once the beverage accessory device is so constructed, a user would pick it up and strike an edge (for illustration purposes only, and not by way of limitation, we will adhere to relative positions of FIG. 1). To illuminate the beverage accessory device, the user would move the beverage accessory device in the direction of arrow A and strike the left side of the beverage accessory device on any suitable somewhat rigid surface. The force of this blow causes the power source 41 to slide from its right-most position, in the direction of arrow B to the left and cause the negative terminal of the power source 41 to contact the negative lead wire 33. Light thereupon is emitted. To turn off the light, the user strikes the right side of the beverage accessory device (direction of arrow B) causing the power source 41 to return to the right inside the power source chamber 21. Contact between the negative wire lead 33 and the negative terminal of the power source 41 is broken and the light thereupon extinguished. Those skilled in the art will recognize, however, that multiple switch mechanisms suited for the intended purposes, such as magnetic switches, mechanical switches, and electrical switches, and the like, may be employed and are not limited to this translating-type switch mechanism.

FIGS. 6 through 10 illustrate a conventional 'push-button' type power switch device 63. What has been described before with regard to the beverage accessory device which bears the same reference numerals for FIGS. 6 through 10 can also apply to this embodiment. One feature that distinguishes this embodiment from the previously discussed embodiment is the switch-facilitating mechanism. In this particular embodiment, the switch-facilitating mechanism generally comprises a mechanical switch device 63 on a foundation member 61, which, in turn, is seated into a ledge 65 in the lid chamber 45. Any conventional switch device 63 will suffice. For this embodiment, however, a 'push-button' style is preferred. Here the positive lead wire 33 from the light source 35 is hard-wired into the foundation member 61 and connected to the switch device 63. Reference point 73 is the solder point for the positive lead wire 33 to the foundation member 61; reference point 74 is the solder point for the negative lead wire 34 to a clip-like member 84 which generally maintains constant contact with the power source 41. The power source 41 is held firmly in place thereat and, when switch device 63 is switched on or off, the light source 35 goes on or off as the case may be.

The clip-like member 84 is configured such that it seats firmly on the power source 41. It must be understood, however, that though the negative wire lead 34 is shown to be in constant contact with the power source 41 via the clip-like member 84, this configuration may be reversed and the positive wire lead 33 may be in constant contact with the power source 41 via the clip-like member 84 instead.

Figure 6:
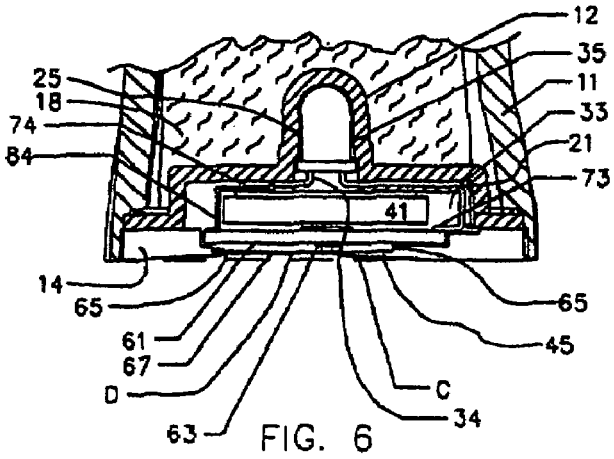
FIG. 6 is a detailed partial view of another embodiment of the beverage accessory of FIG. 1.
Figure 8:
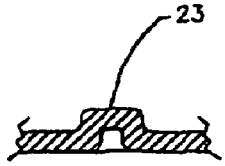
FIG. 8 is a detailed view of a lead chamber in the beverage accessory as taken along line 8-8 of FIG. 7.
Figure 7:
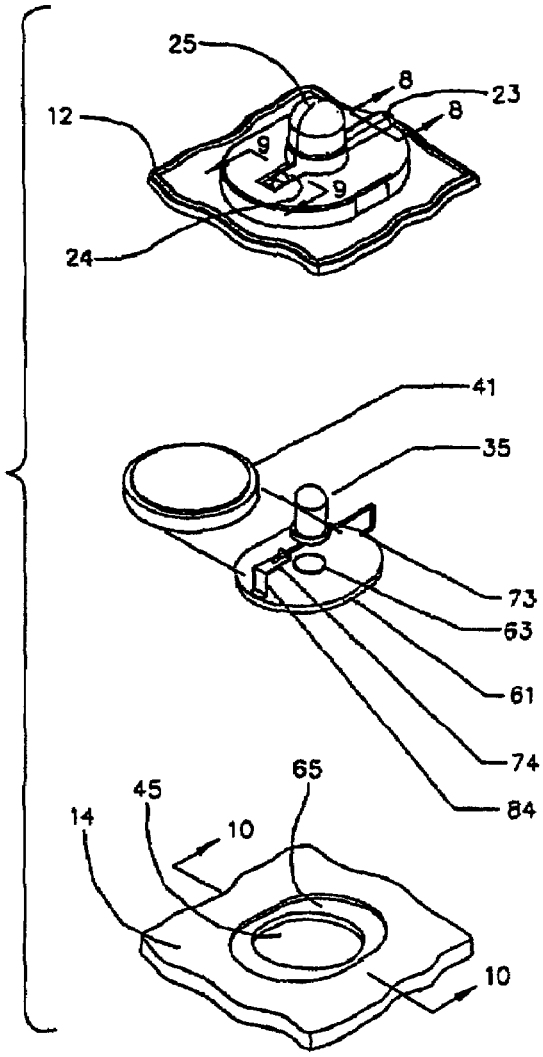
FIG. 7 is an exploded view of a beverage accessory according to another embodiment of the invention.
Figure 9:
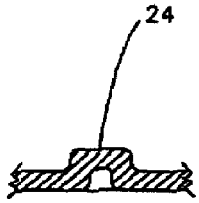
FIG. 9 is a detailed view of another lead chamber in the beverage accessory as taken along line 9-9 of FIG. 7.
Figure 10:
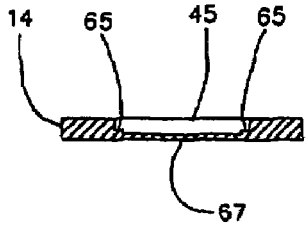
FIG. 10 is a detailed view of the lid as taken along line 10-10 of FIG. 7.

The lid 14 in this embodiment has a lid chamber 45 with a step or ledge 65. As was described, the foundation member 61, with switch device 63 in place, seats into the lid chamber 45 on the ledge 65. The switch device 63 is adjacent to the bottom of the lid chamber 45. The bottom of the lid chamber 45 here is relatively thin (or membrane-like 67) such that it flexes to the touch and exertion of some external pressure. The purpose of this resiliency and flexibility is to permit a user to contact the internal switch device 63 from the outside and to thereby switch the light source 35 'on' or 'off'. FIG. 6, reference character C (represented by phantom line) illustrates the position of the thin layer 67 in its normal position; reference character D illustrates its position after external pressure is exerted on the thin layer 67.

FIGS. 11 through 15 illustrate additional exemplary embodiments of a beverage accessory device. It should be noted, however, that any one or more of the previously described embodiments, components, elements, and features may also be employed with the exemplary embodiments shown in FIGS. 11 through 15.

Figure 11:
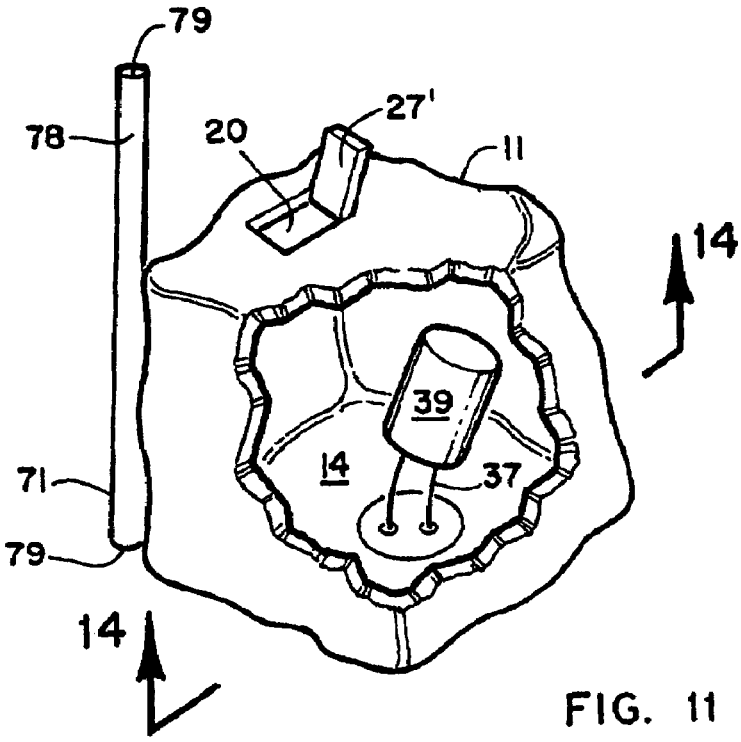
FIG. 11 is a cut-away perspective view of a beverage accessory according to another embodiment of the present invention.

As shown in FIGS. 11 through 15, the inside of the housing 11 is hollow, defining a cavity therein. A filler 18, generally, will be inside the cavity. In FIG. 11, the cavity within the housing 11 is exposed revealing the container 39. The container generally houses the light source 35, the power source 41, and may also, but need not, house the power switch member 163. These components 35, 41, 163 are shown to be encapsulated within the container 39 and, preferably (though not necessarily), in a water-tight fashion. For greater clarity, the filler 18 earlier described is not illustrated in FIGS. 11 through 15 although such can be used when buoyancy is desired, when heat-retaining and cold-retaining features are desired, or when a glow-in-the-dark feature is desired, or any one or more of the above in any desired combination. Buoyancy may also be attained by having an empty cavity. The filler 18, however, can be adapted to maintain the container 39 in suspension in a suspended position within the housing 11. In this regard, the container may be adjacent to any inside wall of the housing 11 (top, bottom, sides) and suspended anywhere within. The filler 18 generally should have buoyant characteristics, may have heat-retaining and cold-retaining characteristics, and may have glow-in-the-dark characteristics. Additionally, glass-like prisms, particles, colored or clear, may be inserted within the cavity, with or without a filler, such that the light from the light-source, when activated, is reflected and/or refracted to create yet an additional feature.

Figure 14:
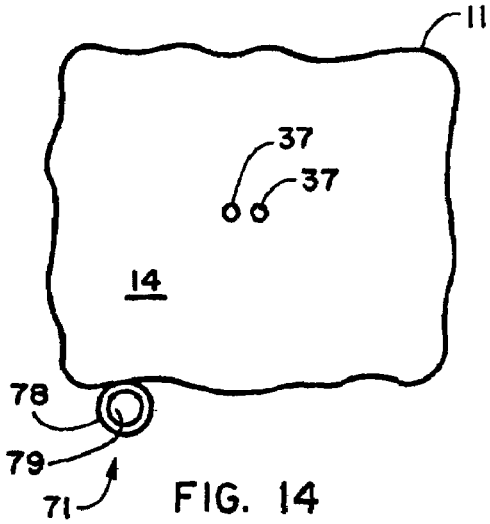
FIG. 14 is a bottom plan view of the device taken along line 14-14 of FIG. 11.
Figure 15:
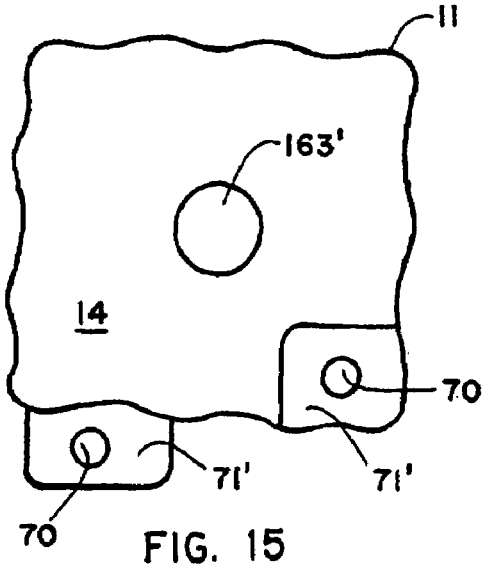
FIG. 15 is a bottom plan view of the device taken along line 15-15 of FIG. 12.

Conductive members 37 establish an on-off (switchable) connection between the power source 41, the light source 35, and a user. The switch member 163 may be manually activated by a user manually engaging a reciprocating switch, a push-button switch 163', or the like, each of which are accessible to a user from outside the housing 11. The switch member 163 also may be automatically activated by immersion of the device into a liquid which causes contact between the conductive members 37 to, depending on the mechanism used, interrupt a circuit and cause power to be delivered to the light source 35; or to complete the circuit and deliver power to the light source 35. FIG. 14 represents the structural feature and function of an automatically-operated switching function (e.g., by placing into a liquid, by covering with one's hand or finger, etc.). FIG. 15 represents the structural feature and function of one type of manually-operated switching function, which in this particular embodiment is a push-button type switch 163'.

Any conventional chip or microprocessor is suited to function as the switch member 163 whether to be manually operated or automatically triggered. Typical such microprocessors are Model PEK 123508 manufactured or distributed by MicroChip; a Basic Discrete Logic Nand-Gate by MicroChip; or any 8-pin chips manufactured or distributed by Holtech. With the container 39 and its components all inside the housing 11, the light 35 may be illuminated automatically by immersing the device into a liquid; or if a manual push-button device is used, the light is illuminated by depressing the push-button device 163'. Many such switches may have a timer to regulate the duration of illumination, while others may have a power-interrupting source (e.g., a strobe, etc.) to cause the illumination to flicker or strobe.

The power source 41 may be solar powered, may be rechargeable, may be permanently affixed to the device, or may be removable, or any compatible combination or combinations thereof. If a rechargeable power source is used, it may be permanently affixed and recharged by placing the entire device on a cooperating and compatible charging device. If a rechargeable power source is used, it may be removable and placed directly on a cooperating and compatible charging device. If removable, the device in such configuration also would encompass a lid 14 which also is removable.

Buoyancy-reduction may be realized in several ways. One manner provides for a removable lid 14 to expose the cavity and filler 18. Any type of weight (ballast) 47 and in any number may be inserted into the cavity to decrease buoyancy to any desired degree such that the device floats in a liquid on the surface, just below the surface, sinks to the bottom, or to any level between the surface and the bottom. The greater the density of the ballast 47, the more in number of the ballast 47, the less buoyancy for the device.

Figure 12:
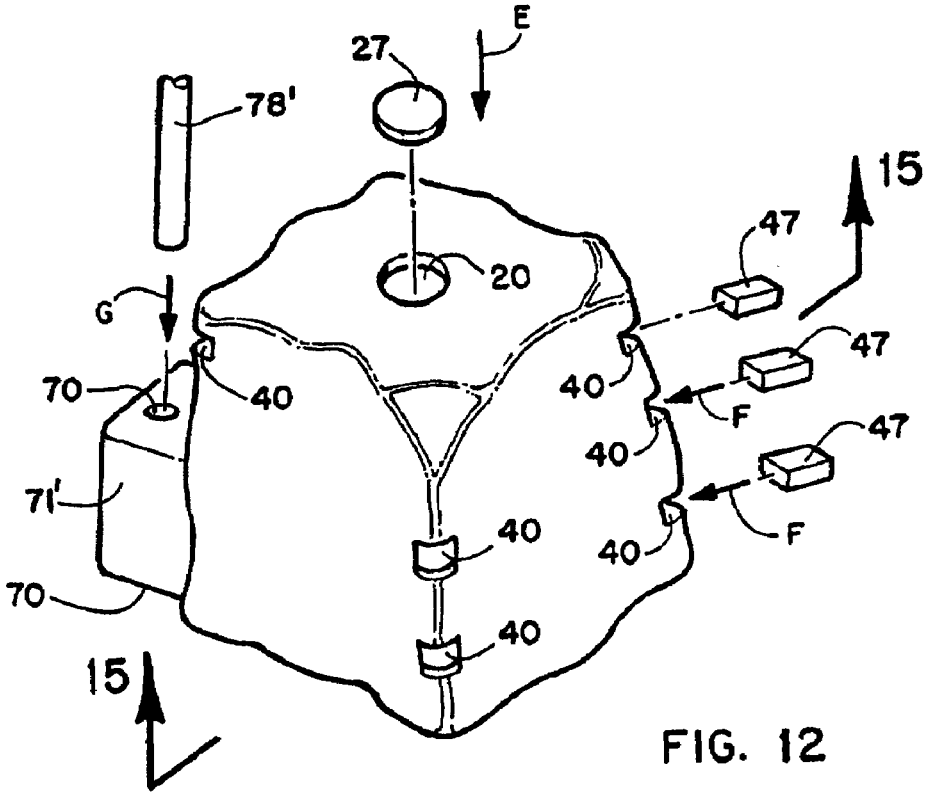
FIG. 12 is a perspective view of another embodiment of a beverage accessory.
Figure 13:
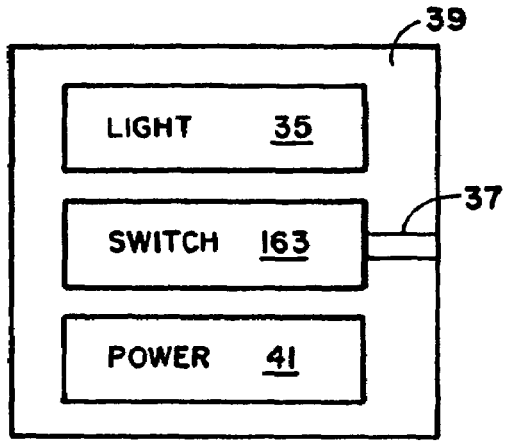
FIG. 13 is a schematic of the light, power, and switching components of the beverage accessory of FIG. 11.

Insertion of the ballast 47 may also be accomplished through an opening 20 on the housing 11 which, when in an open position, exposes the cavity and filler 18 within to the environment. When in the open position, any type and number of weights (ballast) 47 may be inserted into the cavity until the desired buoyancy level is attained. The opening 20 is secured into a closed position by a cap 27, 27' (FIGS. 12 and 11, respectively). The closed position is such that the device maintains a water-tight integrity such that no water or liquid or virtually no water or liquid enters the cavity of the device when the device is immersed into the water or liquid.

As illustrated in FIG. 11, the cap 27' is a cap or door-like member hingedly connected to the opening 20. It opens and closes on the hinge and maintains a secure closure by friction-fit or by cooperating grooves and ribs or detents around the opening 20 and the cap 27'.

FIG. 12 illustrates a cap 27 which is not hingedly connected to the opening 20 but is completely removable from the opening 20. The cap 27 may be friction-fitting to the opening 20, may incorporate cooperating grooves and ribs or detents as above described, or may incorporate cooperating threading to be screwed on (into the closed position) and off (into the open position) as desired. The cap 27 is inserted over the opening 20 by movement in the direction of Arrow E until firmly seated on or into the opening 20.

Though the respective caps 27', 27 are shown as being rectilinear and curvilinear in shape, the caps 27', 27 may encompass any shape and may be placed anywhere on the device provided an open position and a closed position may be achieved and a water-tight integrity, if desired, is or may be attained and maintained. In either case, the device may be an empty cavity into which liquid, as a ballast, is introduced through the opening 20 and suitably sealed. The amount of buoyancy will depend upon the amount of liquid introduced into the cavity through the opening 20.

FIG. 12 also illustrates another buoyancy-reducing feature of the present invention which includes a plurality of slots or slits 40 adapted to receive the designated ballast 47. The slot 40 and respective ballast 47 are sized such that the ballast 47 firmly seats and remains in the slot 40. A user merely inserts any number of ballast members 47 or any type into one or more slots 40 (in the directions of Arrows F) until the desired level of buoyancy is attained.

An additional feature for the present invention is the straw receptacle 71 attached to the housing 11 or to the lid 14. As illustrated in FIG. 11, the straw receptacle 71 is an elongated tube 78 extending away from the device. The elongated tube 78 has an opening or channel 79 completely therethrough from top to the bottom. In FIG. 11, the straw receptacle 71 comprises a single straw-like member (elongated tube) 78. Alternatively, the straw receptacle 71 may also encompass a larger block-like structure 71' as illustrated in FIGS. 12 and 15. With the block-like structure 71', an elongated tube 78 may extend away from the block-like structure 71' provided the channel 79 of the elongated tube 78 extends completely through the block-like structure 71'. This provides for a stronger and more durable straw feature for the device to facilitate or assist a user in consuming the beverage into which the device has been placed.

Referring to FIG. 12, the straw receptacle 71' as a block-like structure may also be structured without a permanent elongated tube 78 thereon but may have an aperture 70 running completely through the straw receptacle 71', which aperture 70 is adapted to receive and hold an externally introduced straw 78' (in the direction of Arrows G as illustrated in FIG. 12).

Figure 16:
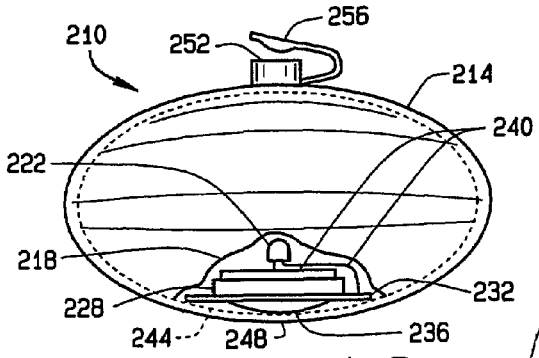
FIG. 16 is a view of another embodiment of a beverage accessory.

FIG. 16 illustrates another embodiment of a beverage accessory device 210. As shown, the beverage accessory device 210 includes an outer housing 214 in which is positioned a filler and an inner container or pod 218.

The inner container 218 includes at least one light source 222, at least one power source 228, and a controller for controlling the operation of the light source 222 in accordance with user input, for example, to provide such features as blinking, strobing, and/or color changes. The controller can include an integrated circuit/printed circuit assembly 232 (e.g., integrated circuits in a printed circuit assembly) and at least one switch 236.

The controller can include any one of a wide range of switches, a push-button switch, a dome push switch, a membrane switch, motion-responsive switches, light-sensitive switches, temperature-sensitive switches, compression switches, voice activated switches, etc. In the particular embodiment shown in FIG. 16, the controller includes a push-button switch 236. In the alternative embodiment shown in FIG. 18, the beverage accessory 410 includes electrical terminals or probes 436 external to the outer container 414. When the beverage accessory device 410 is placed in an electrically conductive liquid, the liquid electrically connects the terminals 436 to one another thereby switchably connecting the light source 422 to the power source 428. Or for example, the terminals 436 can switchably connect the light source 422 to the power source 428 when both terminals 436 are placed in contact with a user's body.

With further reference to FIG. 16, the light source 222, power source 228, integrated circuit/printed circuit assembly 232, switch 236, and leads or conductors 240 can all be encapsulated by the inner container 218 in a preferably fluid-tight fashion. This, in turn, can help prevent the filler within the housing 214 from contacting (and potentially causing problems with the operation of) the various components encapsulated within the inner container 218. In addition, the inner container 218 can also at least help support and retain the positioning of the light source 222, power source 228, and conductors 240 electrically connecting the various components to one another.

In FIG. 16, the inner container 218 is shown coupled (e.g., bonded, adhered, affixed, hot-melted, etc.) to an inner surface 244 of the outer container 214. By way of example only, the inner container 218 can be formed and coupled to the inner surface 244 as follows. First, a vinyl or other suitable material can be sufficiently heated to melt or at least substantially liquefy the vinyl material. The substantially liquefied vinyl material can then be disposed (e.g., poured) over the light source 222, power source 228, integrated circuit/printed circuit assembly 232, switch 236, and leads 240. A sufficient amount of the liquefied vinyl material can be used so that it not only encapsulates the light source 222, power source 228, integrated circuit/printed circuit assembly 232, switch 236, leads 240, but also comes into contact with the inner surface 244. The vinyl material can then be cooled (e.g., passively allowed to cool and/or actively cooled) so that the vinyl material solidifies, thereby forming the inner container 218. Alternatively, other methods can be used to form the inner container and/or the inner container may instead be suspended or floating within the filler as described below and shown in FIG. 17.

The outer container 214 preferably includes at least one externally flexible portion 248 coupled to the switching device 236 such that movement of the flexible portion 248 activates the switching device 236 to connect the light source 222 to the power source 228. The movement of the flexible portion may, for example, be caused by a user applying external pressure to the outer container 214 by squeezing the outer container 214 at the externally flexible surface portion 248.

The outer container 214 can also define at least one opening 252 through which filler can be added to or removed from the outer container 214. The beverage accessory device 210 can include a cap or lid 256 for exposing the opening 252 when the cap 256 is in an open position (as shown in FIG. 16) and for closing the opening 252 when the cap 256 is coupled to the housing 214 in a closed position. In this exemplary manner, filler (e.g., fluids, liquids, gels, oils, ballast, etc.) can be added to or removed from the housing 214, for example, to change the buoyancy of the device 210. In alternative embodiments, however, the outer container does not include an opening for adding or removing filler, such as the device 410 shown in FIG. 18.

In the illustrated embodiment of FIG. 17, the beverage accessory device 310 includes an inner pod 318 suspended by or floating within the filler contained with the housing 314 such that the inner pod 318 is a spaced distance from the housing's sidewalls. At least one light source 322, power source 328, integrated circuit/printed circuit assembly 332, switch 336, and leads 340 can all be encapsulated by the inner container 318 in a preferably fluid-tight fashion.

In the particular embodiment shown in FIG. 17, the switch 336 is a dome or push-button switch. Alternatively, other types of switching devices can also be employed. In addition, the entirety of the outer container 314 is preferably sufficiently flexible (e.g., formed of a relatively soft plastic or vinyl material, etc.) such that applying pressure to (e.g., by a user squeezing or compressing, etc.) any portion of the outer container 314 compresses the filler material within the outer container 314. In turn, the filler material transmits a compression force to the inner container 318 causing the switch 336 to activate and connect the light source 322 to the power source 328. A wide range of filler materials having properties or characteristics suitable for transmitting the compression force to the inner container can be used in the embodiment illustrated in FIG. 17.

Figure 17A:
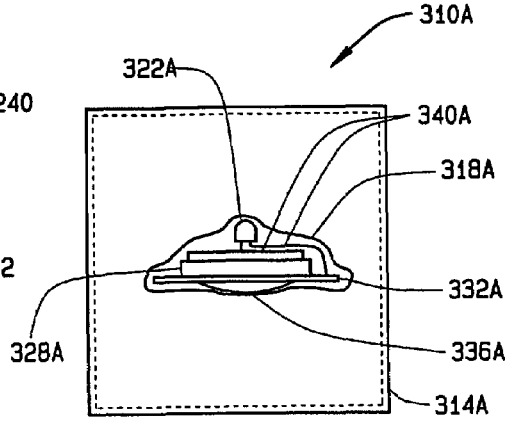
FIG. 17A is a view of another embodiment of a beverage accessory.
Figure 17B:
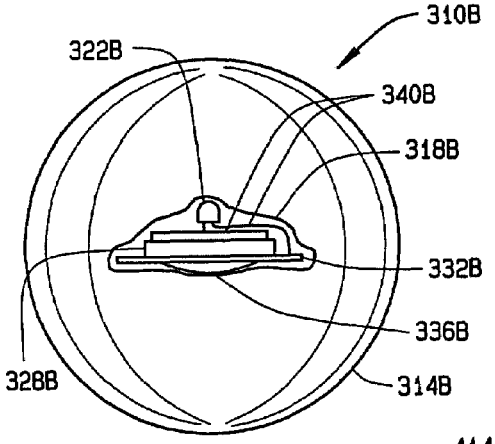
FIG. 17B is a view of another embodiment of a beverage accessory.

In FIG. 17A, the housing 314A is substantially cube-shaped. The housing 314A can also be decorated to resemble an ice cube or ice berg. In FIG. 17B, the housing 314B is substantially spherical. The housing 314B can also be decorated to resemble a sports ball (e.g., golf ball, basketball, soccer ball, baseball, football, tennis ball, etc.). Alternatively, a wide range of other shapes can be used for the housing 314 including food substances (e.g., a food substance (e.g., a slice of fruit, an olive, an onion, etc.) tear drops, rain drops, alphanumeric characters, pyramids, dice, among others.

Figure 19:
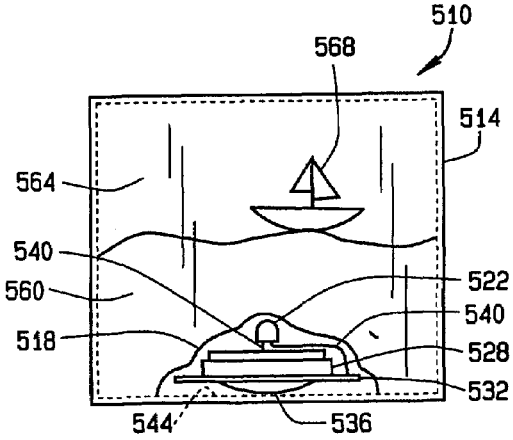
FIG. 19 is a view of another embodiment of a beverage accessory.

With reference now to FIG. 19, there is shown a beverage accessory device 510 that includes a housing 514 in which is disposed at least two fillers 560 and 564 each having different densities. As shown in FIG. 19, the fillers 560 and 564 have separated with the more dense filler 560 having gravitated to the lower portion of the housing 514.

The beverage accessory device 510 can also include a sailboat 568 (or other suitable object) configured to remain or be suspended at about the interface between the fillers 560 and 564. For example, the boat 568 can be sufficiently buoyant to float on the denser filler 560, but have sufficient negative buoyancy to sink in the less dense filler 564. The boat 568 can also be weighted so that it remains generally upright while suspended generally between the two fillers 560 and 564. In other embodiments, the beverage accessory device can include other suitable objects and indicia besides or in addition to boats, such as fish, dolphins, birds, plants, etc.

To even further enhance the visual appeal of the beverage accessory device 510, the denser filler 560 can be blue in color while the other less dense filler 564 is generally clear or transparent. In this exemplary manner, the sailboat 568 can thus appear to be floating on the open sea.

A wide range of materials can be used for the fillers 560 and 564. In one embodiment, the denser filler 560 is liquid water that has been colored or dyed blue, while the other filler 564 is a generally clear oil.

In addition to (or as alternative) to using a blue filler 560, the beverage accessory device 510 can produce blue light to even further reinforce the appearance that the boat is floating on the open sea. By way of example, the beverage accessory device 510 can include one or more LEDs 522 that produce blue light and/or that produce broadband light that travels through a colored filter.

Figure 18:
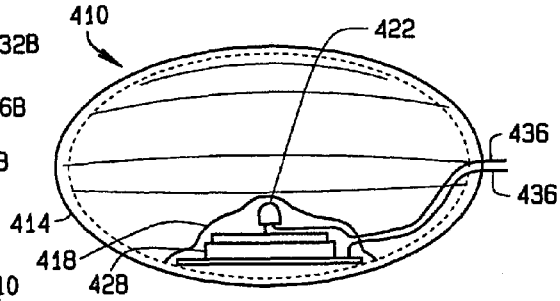
FIG. 18 is a view of another embodiment of a beverage accessory.

As before with FIGS. 16 through 18, the beverage accessory device 510 can also include an inner pod 518 encapsulating in a preferably fluid-tight fashion the LEDs 522, power source 528, conductors 540, and a controller. In FIG. 19, the inner container 518 is shown coupled (e.g., bonded, adhered, affixed, hot-melted, etc.) to an inner surface 544 of the outer container 514. Alternatively, the inner container may instead be configured to be suspended within one of the fillers 560 and 564.

The controller can include an integrated circuit/printed circuit assembly 532 (e.g., integrated circuits in a printed circuit assembly) and at least one switch 536. The switch can include any one of a wide range of switches, a push-button switch, a dome push switch, a membrane switch, motion-responsive switches, light-sensitive switches, temperature-sensitive switches, compression switches, voice activated switches, moisture-sensitive switches, etc.

A wide range of materials can be used for the outer and inner containers 214, 218, 314, 318, 414, 418, 514, 518 shown in FIGS. 16 through 19. In preferred implementations, the inner and outer containers are formed from a biologically safe material that has properties suitable for placing it in contact with a material that is to be ingested and falls under the Food and Drug Administration food-contact grade properties. Exemplary materials include polyvinyl chloride (PVC), polymers, plastics, flexible materials, rigid materials, materials capable of being mass produced with relatively low manufacturing costs, among other materials suited for the intended purpose.

In embodiments which the filler material is freezable, an internal cavity without any the freezable filler can be defined between the switching device and a flexible sidewall portion of the outer container. This internal cavity can enable a compression force initially applied to the outer container to be transmitted to the inner container for activating the switching device therein even when the filler material is frozen solid. Alternatively, the inner container can be flush against and in contact with a flexible sidewall portion of the housing such that movement to the flexible sidewall portion activates the switching device regardless of whether the filler is frozen or not.

Figure 20:
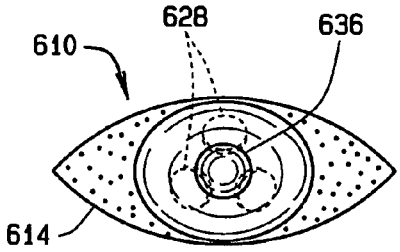
FIG. 20 is a view of another embodiment of a beverage accessory.
Figure 21:
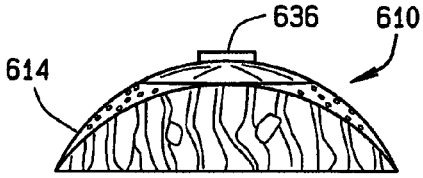
FIG. 21 is another view of the beverage accessory shown in FIG. 20.

FIGS. 20 and 21 illustrate a beverage accessory device 610 that includes a housing 614 adapted to resemble a slice or piece of an orange fruit. In alternative embodiments, the housing can be adapted to resemble other pieces or entire fruits, such as slices of a lime or lemon.

As shown in FIGS. 20 and 21, the beverage accessory device 610 includes a push-button switch 636, but other types of switches can also be employed. In operation, the push-button switch 636 switchably connects one or more light sources to one or more power sources 628 (shown in phantom). In the particular illustrated embodiment, the power sources include three watch batteries, although other suitable types and numbers of power sources (e.g., rechargeable or quick-charging capacitors, etc.) can be used depending on the particular application.

In various embodiments, the beverage accessory device can produce light having a color consistent with the color of the fruit or object that the beverage accessory is intended to resemble. For example, the beverage accessory device 610 shown in FIG. 17 may be configured to produce orange light so as to even further reinforce the beverage accessory's appearance as an orange slice. The beverage accessory device 610 can include one or more LEDs that produce orange light and/or broadband light that travels through a colored filter.

Other embodiments include a beverage accessory adapted to resemble a lemon slice and that produces yellow light, and a beverage accessory adapted to resemble a lime slice and that produces green light. Accordingly, various embodiments of the invention include a beverage accessory device that produces thematic light (e.g., certain colors, etc.) consistent with the particular object or theme for which the device configured to resemble.

Figure 22:
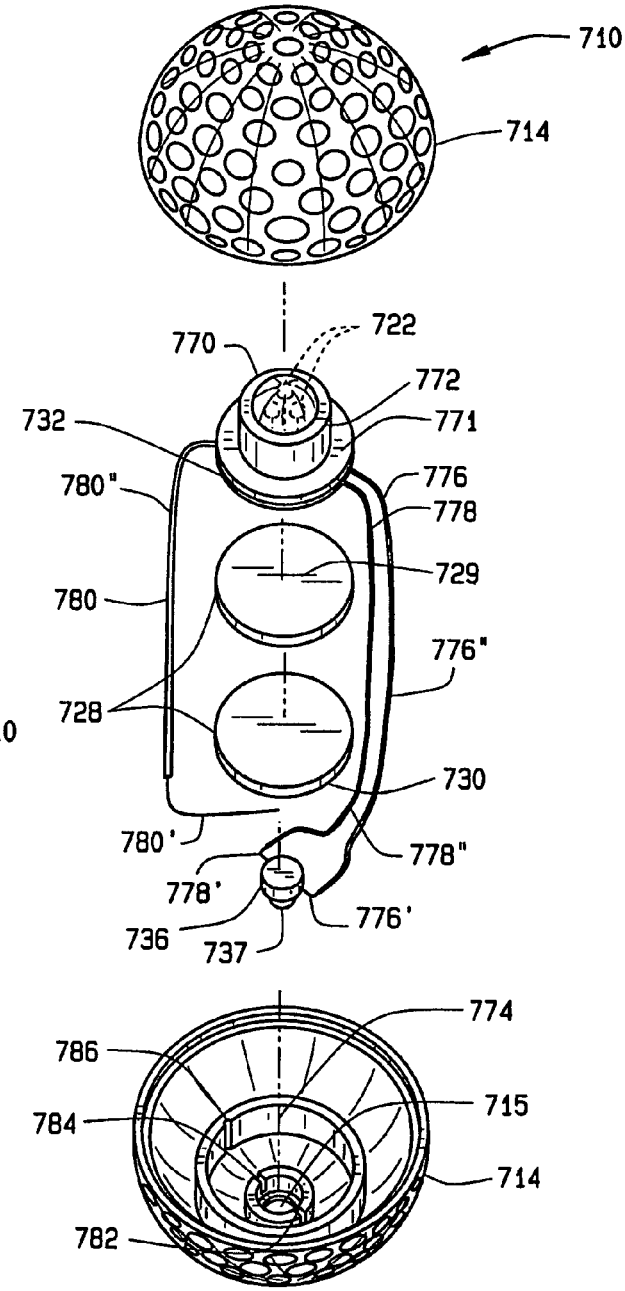
FIG. 22 is an exploded perspective view of another embodiment of a beverage accessory.
Figure 23:
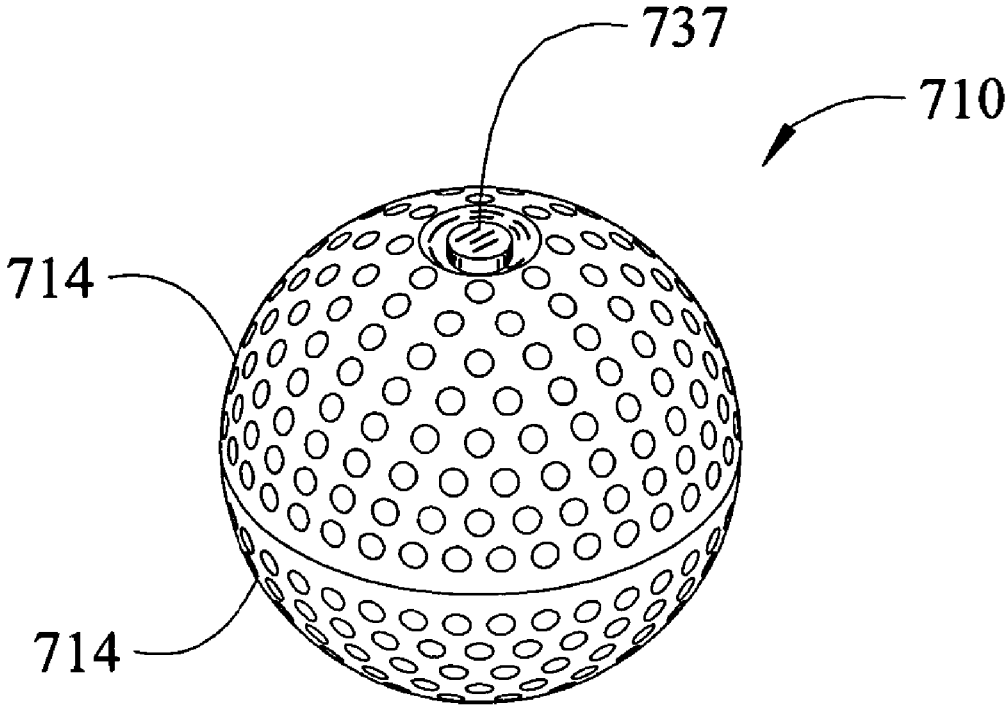
FIG. 23 is a perspective view of the beverage accessory shown in FIG. 22.

FIGS. 22 and 23 illustrates another embodiment of a beverage accessory device 710 adapted to resemble a golf ball. As shown, the device 710 includes a generally spherical housing 714 with a dimpled external surface.

The beverage accessory device 710 further includes a cartridge 770 sized to be received within the housing 714. The cartridge 770 defines a light source chamber 772 thereunder sized to receive one or more light sources, such as the LEDs 722 (shown in phantom). The housing 714 and cartridge 770 cooperate to define a power source chamber 774 sized to receive one or more power sources. In the particular illustrated embodiment, the power source chamber 774 is sized to receive two three-volt lithium batteries 728 electrically connected in series.

The beverage accessory device 710 can also include a controller for controlling the operation of the LEDs 722 in accordance with user input, for example, to provide such features as blinking, strobing, and/or color changes. The controller can include an integrated circuit/printed circuit assembly 732 (e.g., integrated circuits in a printed circuit assembly) and at least one switch 736.

The switch 736 is a push-button switch having a portion 737 sized to extend through an opening 715 defined by the housing 714. A user can thus activate the switch 736 by pressing on the portion 737 of the switch 736 extending out through the opening 715 in the housing 714. Alternatively, a wide range of other switching devices can be employed for the device 710.

With further reference to FIG. 22, the integrated circuit/printed circuit assembly 732 can be disposed generally between the light source chamber 772 and the power source chamber 774. The integrated circuit/printed circuit assembly 732 can include an electrically conductive lower surface configured to electrically contact the upper terminal 729 (whether a negative terminal or cathode or a positive terminal or anode) of the upper battery 728 when the beverage accessory device 710 is fully assembled.

The beverage accessory device 710 can also include a plurality of conductors or leads 776, 778, 780. As shown, the leads 776, 778 are electrically connected to the switch 736. The lead 780 is configured to contact the lower terminal 730 (whether a negative terminal or cathode or a positive terminal or anode) of the lower battery 728 when the beverage accessory device 710 is fully assembled.

The housing 714 can also define grooves or channels 782, 784, 786 each for engaging a different one of the wire leads 776, 778, 780. Engaging the wire leads 776, 778, 780 within the corresponding grooves 782, 784, 786 can help maintain the positioning of the wire leads and reduce the chance that the wire leads will be electrically disconnected from the light source 722, power source 728, integrated circuit/printed circuit assembly 732, and/or switch 736 as the case may be.

Each wire lead 776, 778, 780 can include electrically-insulative portions 776', 778', 780' and electrically conductive portions 776", 778", 780". The electrically-insulative portions 776', 778', 780' can help prevent short circuiting that might otherwise occur if the electrically conductive portions 776", 778", 780" physically contacted each other and/or the battery sidewalls.

In some embodiments, the cartridge 770 can also define channels (not shown) similar to the lead channels 23, 24 defined by the cartridge 12 described above. For example, in one embodiment, the flange portion 771 of the cartridge 770 can define channels (e.g., grooves, holes, etc.) for the leads 776, 778, 780. In other embodiments, however, the cartridge 770 does not define any of such lead channels.

Figure 24:
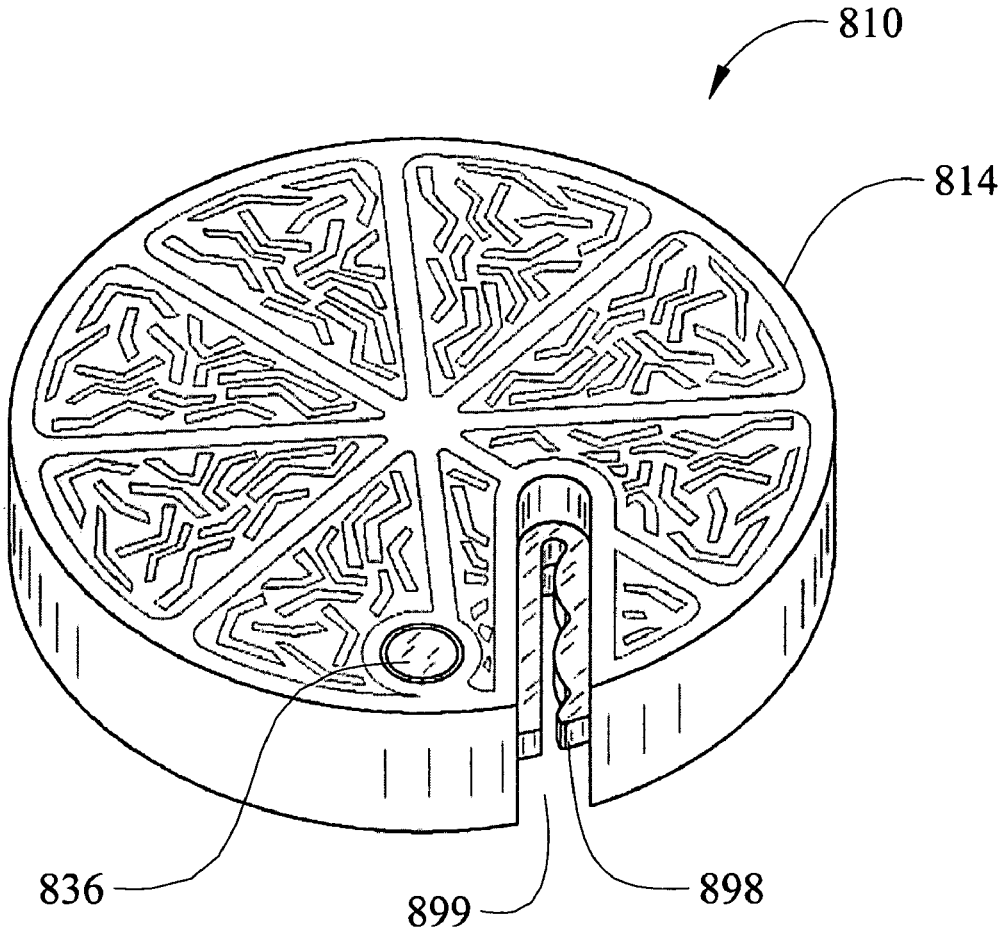
FIG. 24 is a perspective view of another embodiment of a beverage accessory.
Figure 25:
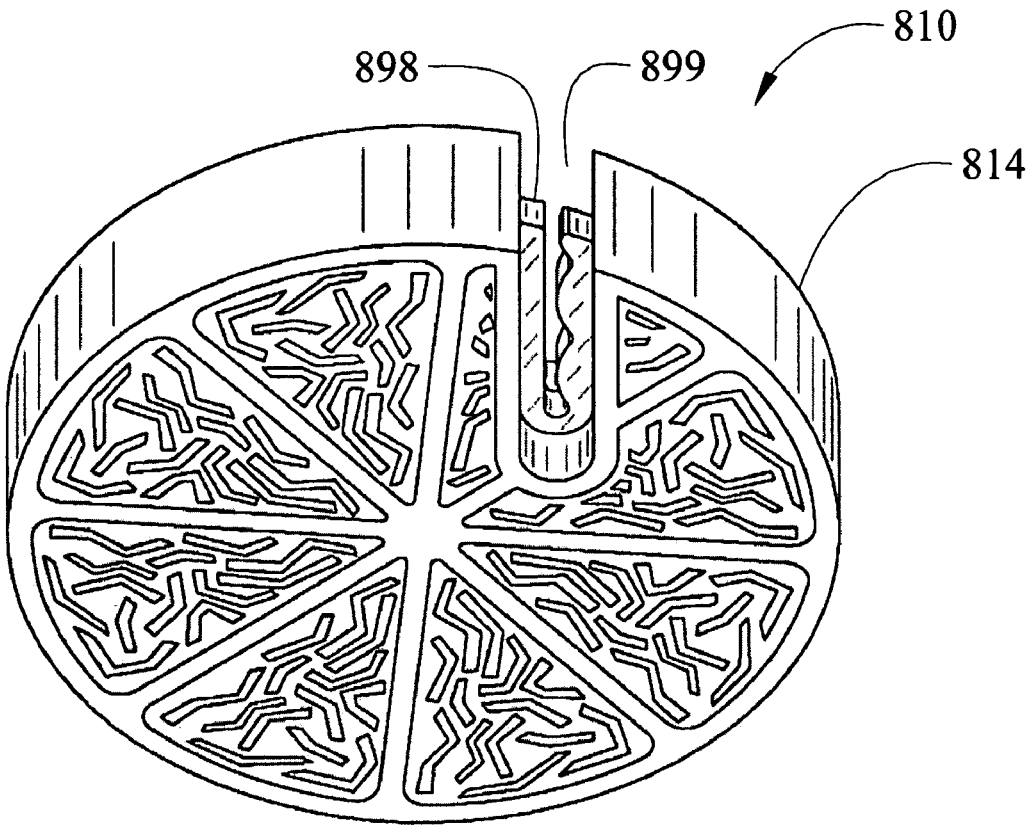
FIG. 25 is a lower perspective view of the beverage accessory shown in FIG. 24.

FIGS. 24 and 25 illustrate a beverage accessory device 810 that includes a housing 814 adapted to resemble a slice of fruit, such as lemon or a lime. In alternative embodiments, the housing can be adapted to resemble other pieces or entire fruits.

As shown in FIG. 24, the beverage accessory device 810 includes a push-button switch 836, but other types of switches can also be employed. In operation, the push-button switch 636 switchably connects one or more light sources to one or more power sources, e.g., watch batteries, etc.

In this particular embodiment, the beverage accessory device 810 also includes a resilient material 898 disposed within a slot or opening 899 of the housing 814. The beverage accessory device 810 can be placed on the rim of a beverage receptacle with the resilient material 898 frictionally gripping the beverage receptacle. In some embodiments, the slot 899 can include a switching mechanism (e.g., electrical terminals, push-button switch, etc.) that automatically activates the switch and connects the light source(s) of the device 810 to a power source, when the device 810 is placed onto the rim of a glass or other beverage receptacle.

Figure 26:
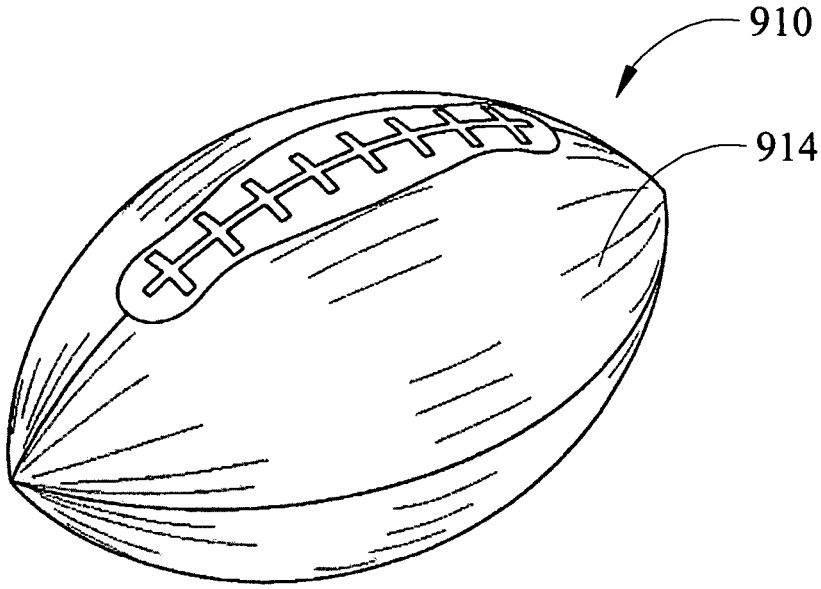
FIG. 26 is a perspective view of another embodiment of a beverage accessory.
Figure 27:
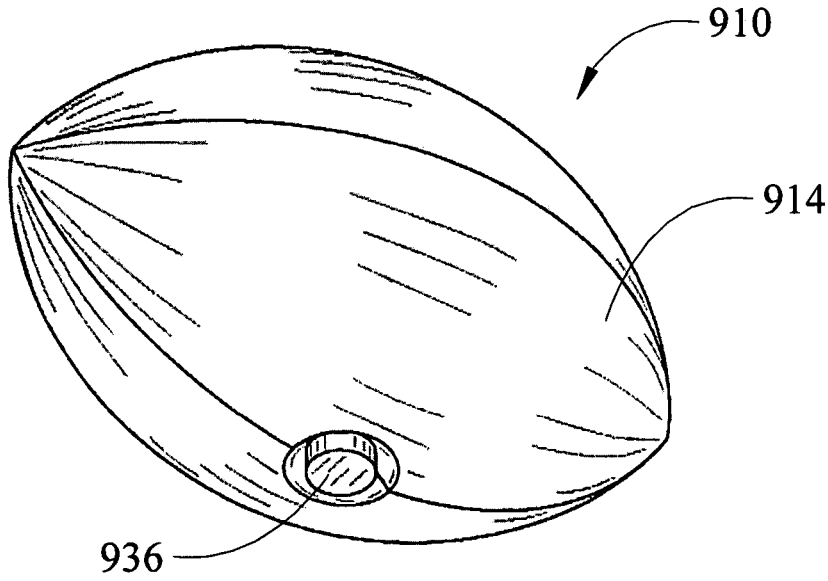
FIG. 27 is a lower perspective view of the beverage accessory shown in FIG. 26.

FIGS. 26 and 27 illustrate a beverage accessory device 910 that includes a housing 914 adapted to resemble a football. In alternative embodiments, the housing can be adapted to resemble other sports ball, such as a soccer ball, baseball, etc.

As shown in FIG. 27, the beverage accessory device 910 includes a push-button switch 936, but other types of switches can also be employed. In operation, the push-button switch 936 switchably connects one or more light sources to one or more power sources, e.g., watch batteries, etc.

Figure 28:
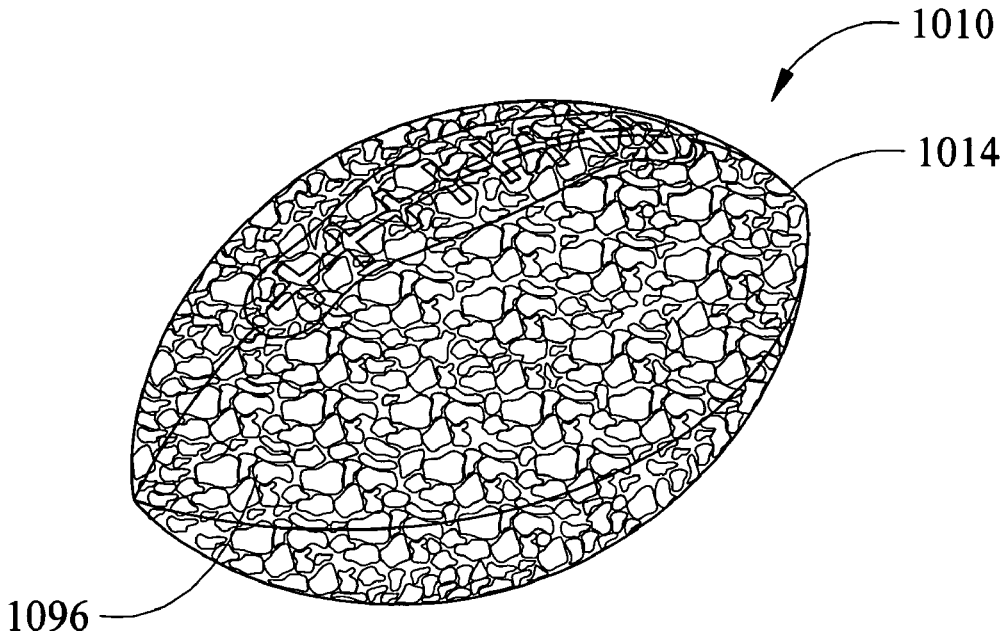
FIG. 28 is a perspective view of another embodiment of a beverage accessory.
Figure 29:
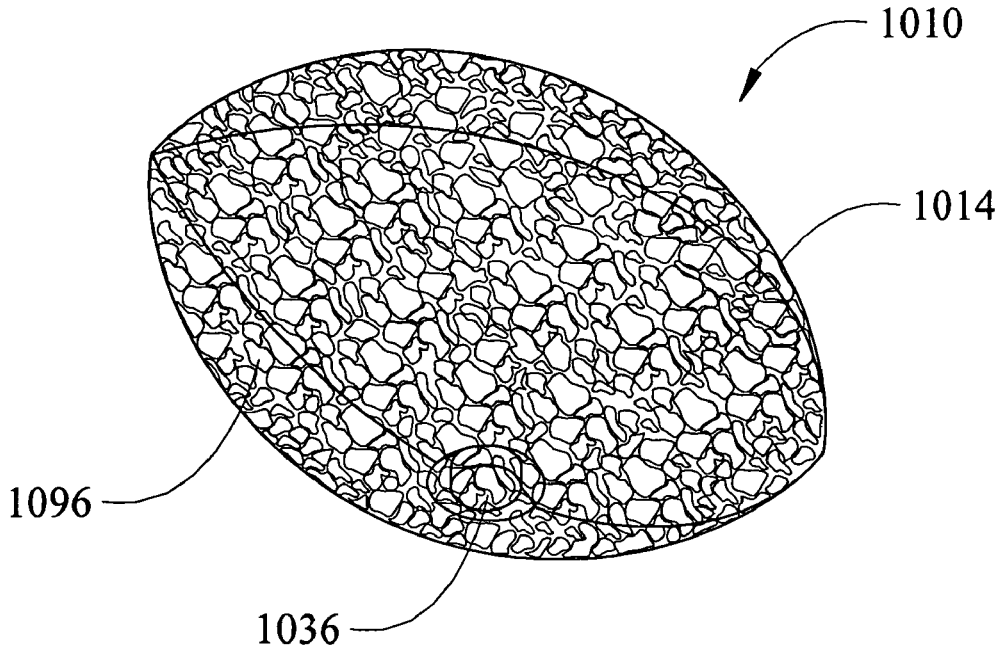
FIG. 29 is a lower perspective view of the beverage accessory shown in FIG. 28.

FIGS. 28 and 29 illustrate another beverage accessory device 1010 having a housing 1014 resembling a football. As shown in FIG. 28, this beverage accessory device 1010 also includes a push-button switch 1036. But other types of switches can also be employed. In operation, the push-button switch 1036 switchably connects one or more light sources to one or more power sources, e.g., watch batteries, etc.

In this particular embodiment, a beaded material 1096 is within the housing 1014. The beaded material 1096 may comprise a wide variety of materials and configurations. In one exemplary embodiment, the beaded material 1096 comprise pellets formed from plastic and/or acrylic pellets. Alternative embodiments can include a beaded material formed of other materials capable of altering light by one or more of refracting, reflecting, diffracting, and dispersing light.

With continued reference to FIGS. 28 and 29, the beaded material 1096 includes a plurality of surfaces that can receive and alter the light emitted by one or more electric light sources within the housing 1014. By altering the light in this exemplary manner, a visibly pleasing or sparkling light effect may be produced by the device 1010. This light display can be particularly pleasing in embodiments in which the housing 1014 is made of a substantially transparent material such that the housing 1014 tends to disappear or not be readily visible thereby giving the impression of small points of light within the beverage receptacle. Indeed, various embodiments can produce such visibly pleasing light effects that a user may simply choose to use the device even while not consuming a beverage. Alternatively, the housing 1014 can be formed from other materials, including non-transparent materials.

Figure 30:
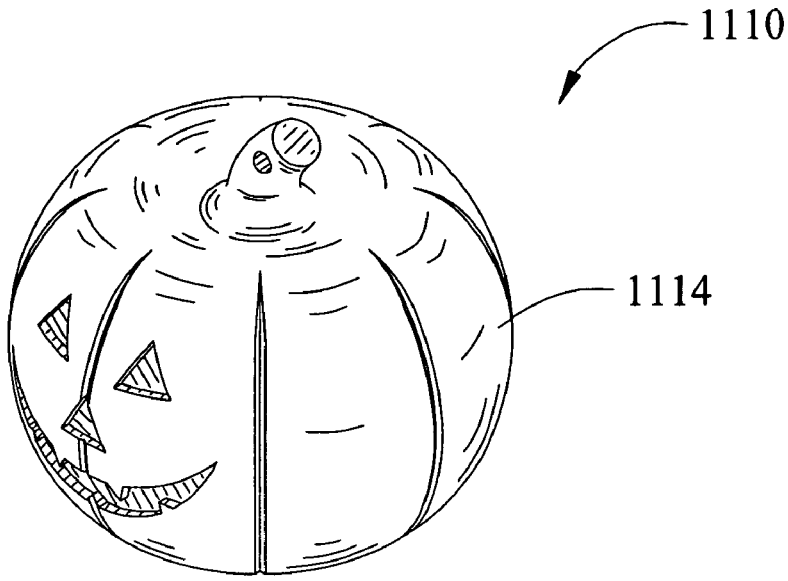
FIG. 30 is a perspective view of another embodiment of a beverage accessory.
Figure 31:
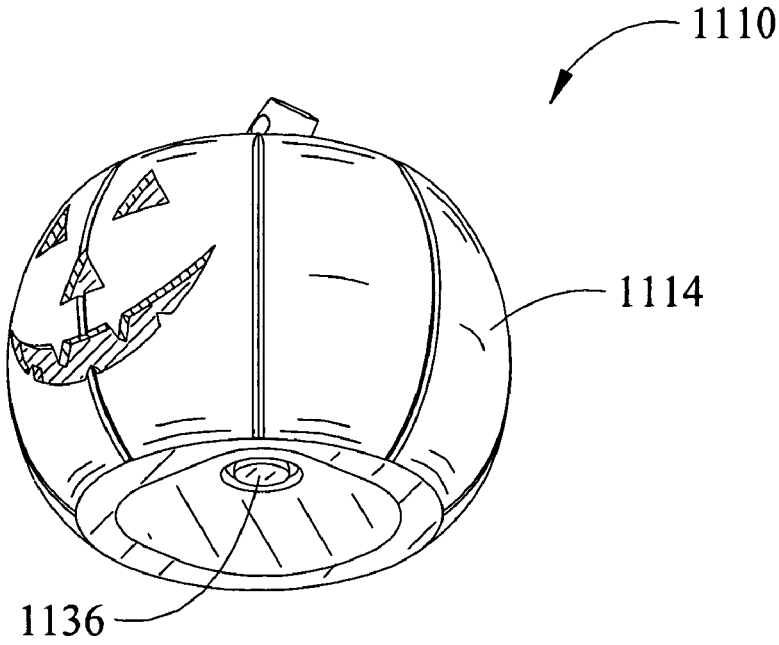
FIG. 31 is a lower perspective view of the beverage accessory shown in FIG. 30.

FIGS. 30 and 31 illustrate a beverage accessory device 1110 having a housing 1114 configured to resemble a jack-o-lantern (although other configurations are possible). As shown in FIG. 31, the beverage accessory device 1110 includes a push-button switch 1136, but other types of switches can also be employed. In operation, the push-button switch 1136 switchably connects one or more light sources to one or more power sources, e.g., watch batteries, etc.

In any of the various embodiments disclosed herein, a beverage accessory device can also include means for allowing the buoyancy of the beverage accessory device to be adjusted, for example, to float on top of a beverage, to submerge to a suitable depth within the beverage, or to sink completely to the bottom of the beverage. This buoyancy adjustment can be realized in several ways. In various implementations, buoyancy-reduction is accomplished by simply positioning one or more batteries within a power source chamber. In which case, the buoyancy of the device will be determined, at least in part, on the type and number of power sources positioned within the power source chamber. Another exemplary manner for adjusting buoyancy can include the device having a lid or cap for exposing an internal cavity to allow a fluid (e.g., liquid, air, etc.) to be inserted into the cavity to adjust the buoyancy of the device.

Alternatively, any of the various embodiments disclosed herein may include ballast fixedly attached to or not readily removable from the beverage accessory device. In such alternative embodiments, the ballast may be provided in order to give the beverage accessory device a particular level of buoyancy. For example, various embodiments can includes a beverage accessory device configured such that it has three-fourths buoyancy in liquid water such that the device is submerged within and resides at about a level three-fourths of the way upward from the bottom of a beverage receptacle having liquid water therein. As other example embodiments, a beverage accessory device can be configured so as to be only partially submerged within and reside at about the top of the liquid water within the beverage receptacle. Still other example embodiments can include a beverage accessory device configured to sink to the bottom of the beverage receptacle having liquid water therein.

In various embodiments of the invention, the device's exterior can be provided in various shapes, sizes, and/or be adapted to resemble a wide range of objects, such as a simulated ice cube (e.g., FIGS. 1, 11, 12, and 17A, etc.), an ice berg, a test-tube-like or capsule-like structure, a sphere (e.g., FIG. 17B, etc.), a cube with a boat floating on the open sea (e.g., FIG. 19, etc.), a food substance (e.g., a slice of fruit (e.g., FIGS. 20, 21, 24, and 25, etc.), an olive, an onion, etc.), a jack-o-lantern (e.g., FIGS. 30 and 31, etc.), dice, a golf ball (e.g., FIGS. 22 and 23, etc.), a football (e.g., FIGS. 26 through 29, etc.), other sports ball shapes (e.g., basketball, soccer ball, baseball, etc.), and the like. Any of these various embodiments can be illuminatable and/or immersible in a liquid (to float or partially or completely sink within a liquid).

In any of the various embodiments disclosed herein, the beverage accessory can include a plurality of light-altering particles (e.g., glitter, reflective particles, refractive particles, translucent particles, glass-like prisms, colored particles, clear particles, etc.) within the housing (e.g., suspended within the hot/cold gel or other suitable substance within the housing). These particles can receive and alter the light from a light source to create yet an additional feature. In addition to, or as an alternative to having light-altering particles within the housing, some embodiments also include a housing having an inner and/or outer surface that is configured for altering the light. For example, the housing can include inner and/or outer faceted surface portions. As other examples, crushed crystal or crystal-like materials may be disposed along an inner surface portion of the housing. Further examples can include a housing having an inner surface portion configured with pyramidal or triangular facets such that this inner faceted surface portion is operable as a lens for altering the light (e.g., magnifying, improving disbursement of, etc.) the light. Such facets can take on a wide variety of configurations (e.g., shapes, sizes, relative positioning, etc.), and each facet does not necessarily have the same configuration as the other facets. In these various embodiments that include some means for altering the light, the beverage accessory device can produce a visibly pleasing or sparkling light effect. This light display can be particularly pleasing in embodiments in which the housing is made of a substantially transparent material such that the housing tends to disappear or not be readily visible thereby giving the impression of small points of light within the beverage receptacle. Indeed, various embodiments can produce such visibly pleasing light effects that a user may simply choose to use the device even while not consuming a beverage.

In any of the various embodiments disclosed herein, the operation of the light sources may be controlled by a controller in accordance with user input to provide such features as blinking, strobing and/or color changes. The controller can include an integrated circuit/printed circuit assembly (e.g., integrated circuits in a printed circuit assembly) and at least one switch. The switch may, for example, allow the user to select from among various display modes for the light sources, such as an off-light mode, an on-light mode, a mode in which each of the light sources simultaneously emit steady or non-flashing light, a mode in which the light sources emit light intermittently, a mode in which the various light sources illuminate or blink at different times in accordance with a predetermined sequence or order, a mode in which the light sources emit light that phases between or blends colors, a mode in which the light sources emit light randomly, a mode in which the light sources pulsate to sounds (e.g., music at a nightclub, etc.), and/or a mode combining one or more of the foregoing. Such sounds may be produced by the lighted item itself (e.g., via a speaker built-in to the lighted item) or a source external to the lighted item (e.g., ambient sounds). In some embodiments, sounds can cause synchronized pulsation of the light sources of two or more different lighted items, thus providing a pleasing light pattern or effect.

In any of the various embodiments of the invention, the housing, or at least a portion thereof, can be ultraviolet-reactive, and the light source(s) can produce ultraviolet light for illuminating the ultraviolet-reactive housing. For example, the housing, or at least a portion thereof, can be responsive to the ultraviolet A (UVA) radiation component of black light produced by the light source, which, in turn, produces a visually stimulating effect. Additionally, or alternatively, a beverage accessory can also include an ultraviolet-reactive material within the housing. In which case, the ultraviolet-reactive material can be responsive to the ultraviolet A (UVA) radiation component of black light produced by the light source, which, in turn, produces a visually stimulating effect. Exemplary ultraviolet-reactive materials that can be used for a housing and/or a filler within the housing include plastic materials containing phosphor (e.g., Zinc Sulfide, Strontium Aluminate, etc.) and fluorescent materials.

In any of the various embodiments disclosed herein, a beverage accessory device may include a vibrator for causing the beverage accessory device to vibrate. In such embodiments, the vibrator may be configured for imparting sufficient vibration to the beverage accessory device for also imparting at least some vibration to the liquid within the beverage receptacle in which the beverage accessory device is placed. By way of example only, the vibrator may comprise a relatively small motor off-access or a piezoelectric buzzer. Other examples of vibrators include an electromagnetic motor, rotor shaft, and eccentric rotor.

Accordingly, various embodiments can provide a relatively easy and inexpensive way to enhance a mood or atmosphere of an occasion, to provide visual pleasure or serenity (e.g., enhance one's enjoyment while consuming a beverage), to convey messages to users (e.g., by providing the device with one or more indicia), among other numerous novelty-related results. Various embodiments can be adapted to accept and maintain an external drinking implement (such as a straw) to facilitate drinking or sipping a beverage.

Various embodiments can also include fillers capable of imparting heating, cooling, glow-like illumination, and/or luminescence to the adjacent environment. A wide range of fillers can be used in any one or more of the embodiments disclosed herein. Examples of fillers are now provided for purposes of illustration only, and not for purposes of limitations. In this regard, some embodiments can include one or more of the following fillers: polystyrene blend, acrylic, plastic beads or pellets, blue-ice refrigerant, fillers having a specific heat capacity which is higher than the specific heat capacity of air, fillers having a specific heat capacity which is comparable, higher, or lower than the specific heat capacity of water, fillers having heat-retaining and/or cold-retaining properties greater than air alone, fillers including eutectic salts, candle wax, polyethylene, polypropylene, phase change materials, filler having a specific heat capacity within a range of about 2300 joules per kilogram per degree Celsius to about 2500 joules per kilogram per degree Celsius, gels, water, and/or materials generally used in re-usable ice-packs, re-usable heating pads, hot/cold gel packs, single-use hand and toe warmers.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order or performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A beverage accessory device for use within a beverage receptacle, the beverage accessory device comprising a housing having sidewalls defining a cavity therein, a substantially fluid-tight container within the cavity of the housing, the container having sidewalls at least one of which is spaced apart from at least one of the housing's sidewalls such that a portion of the housing's cavity remains separating the at least one container sidewall from the at least one housing sidewall, the container's sidewalls defining a chamber configured to receive therein at least one power source, at least one electric light source substantially entirely within the container's chamber, whereby the at least one electric light source is operable for illuminating at least a portion of a liquid within the beverage receptacle when the beverage accessory device is within the beverage receptacle, and a filler within the portion of the cavity separating the at least one container sidewall from the at least one housing sidewall, and wherein the container substantially isolates the at least one electric light source and the filler by inhibiting contact therebetween.

2. The device of claim 1, wherein the filler suspends the container in a suspended position within the housing's cavity such that a spaced distance separates each container sidewall from each housing sidewall.

3. The device of claim 1, wherein the filler comprises fluid.

4. The device of claim 1, wherein the filler comprises gel.

5. The device of claim 1, further comprising electrical terminals external to the housing for switchably connecting the at least one electric light source to at least one power source when the beverage accessory device is placed in a liquid and the liquid electrically connects the terminals to one another.

6. The device of claim 5, wherein the electrical terminals are defined by at least one conductor extending from within the container's chamber through the housing's cavity and terminating external to the housing.

7. The device of claim 1, wherein the container encapsulates the at least one electric light source and at least one conductor electrically connected to the at least one electric light source such that the container supports and restrains movement of the at least one electric light source relative to the at least one conductor.

8. The device of claim 1, wherein the housing and the container are substantially transparent such the housing and the container are not readily visible when the beverage accessory device is within a liquid and the at least one electric light source is emitting light.

9. The device of claim 1, wherein the housing integrally defines a portion of the container.

10. A beverage accessory device for use within a beverage receptacle, the beverage accessory device comprising a housing, at least one electric light source within the housing, and gel within the housing, the gel configured such that the gel, upon physical contact with one or more electrical components of the beverage accessory device, does not adversely impact the operation of the at least one electric light source, whereby the at least one electric light source is operable for illuminating at least a portion of a liquid within the beverage receptacle when the beverage accessory device is within the beverage receptacle.

11. The device of claim 10, wherein the gel comprises polyacrylamide and petroleum oil.

12. The device of claim 11, wherein the gel comprises a beaded material.

13. The device of claim 12, wherein the beaded material comprises at least one of plastic or acrylic.

14. A beverage accessory device for use within a beverage receptacle, the beverage accessory device comprising a housing, at least one electric light source within the housing, and gel within the housing, the gel having a specific heat capacity within a range of about 2300 joules per kilogram per degree Celsius to about 2500 joules per kilogram per degree Celsius, whereby the at least one electric light source is operable for illuminating at least a portion of a liquid within the beverage receptacle when the beverage accessory device is within the beverage receptacle.

15. A beverage accessory device for use within a beverage receptacle, the beverage accessory device comprising a housing, at least one electric light source within the housing, and gel within the housing, the gel comprising at least one of polyethylene or polypropylene, whereby the at least one electric light source is operable for illuminating at least a portion of a liquid within the beverage receptacle when the beverage accessory device is within the beverage receptacle.

16. A beverage accessory device for use within a beverage receptacle, the beverage accessory device comprising a housing, at least one electric light source within the housing, gel within the housing, whereby the at least one electric light source is operable for illuminating at least a portion of a liquid within the beverage receptacle when the beverage accessory device is within the beverage receptacle, and a plurality of light-altering particles within the housing for receiving and altering light emitted by the at least one electric light source by at least one or more of refracting, reflecting, diffracting, dispersing, and diffusing such that the altered light illuminates at least a portion of a liquid within the beverage receptacle when the beverage accessory device is within the beverage receptacle.

17. The device of claim 16, wherein the light-altering particles include at least one or more of glitter, reflective particles, refractive particles, translucent particles, glass-like prisms, colored particles, faceted particles, and clear particles.

18. The device of claim 16, wherein the light-altering particles are suspended in the gel.

19. A beverage accessory device for use within a beverage receptacle, the beverage accessory device comprising a housing, at least one electric light source within the housing, and a plurality of light-altering particles within the housing for receiving and altering light from the at least one electric light source by at least one or more of refracting, reflecting, diffracting, dispersing, and diffusing, whereby the at least one electric light source is operable for producing light which is altered by the light-altering particles such that the altered light illuminates at least a portion of a liquid within the beverage receptacle when the beverage accessory device is within the beverage receptacle.

20. The device of claim 19, wherein the light-altering particles include at least one or more of glitter, reflective particles, refractive particles, translucent particles, glass-like prisms, colored particles, faceted particles, and clear particles.

21. The device of claim 19, further comprising a filler within the housing in which the light-altering particles are suspended.

22. The device of claim 19, wherein the light-altering particles comprises a beaded material within the housing.

23. The device of claim 19, wherein the light-altering particles comprise gel.

24. The device of claim 19, wherein the housing is substantially transparent such that the housing is not readily visible when the beverage accessory device is within a liquid and the at least one electric light source is emitting light being altered by the light-altering particles and illuminating at least a portion of the liquid.

25. A beverage accessory device for use within a beverage receptacle, the beverage accessory device comprising a housing, at least one electric light source within the housing, and a beaded material within the housing, the beaded material having a plurality of surfaces positioned relative to the at least one electric light source for receiving and altering light from the at least one electric light source, whereby the at least one electric light source is operable for producing light at least a portion of which is altered by the beaded material and illuminates at least a portion of a liquid within the beverage receptacle when the beverage accessory device is within the beverage receptacle.

26. The device of claim 25, wherein the beaded material alters the light emitted by the at least one electrical light source by at least one or more of refracting, reflecting, diffracting, and dispersing light.

27. The device of claim 25, wherein the beaded material comprises a plurality of pellets.

28. The device of claim 27, wherein the pellets comprise at least one or more of plastic or acrylic.

* * * * *